US008760043B2

(12) United States Patent
Gielen et al.

(10) Patent No.: US 8,760,043 B2
(45) Date of Patent: Jun. 24, 2014

(54) LED-BASED ELECTRIC LAMP

(75) Inventors: Vincent S. D. Gielen, Eindhoven (NL); Johannes P. M. Ansems, Eindhoven (NL); Berend J. W. Ter Weeme, Eindhoven (NL); Peter J. M. Bukkems, Eindhoven (NL); Justin (Yun fei) Xu, Shanghai (CN)

(73) Assignee: Koninklijke Philips N.V., Eindhoven (NL)

( * ) Notice: Subject to any disclaimer, the term of this patent is extended or adjusted under 35 U.S.C. 154(b) by 0 days.

(21) Appl. No.: 13/108,407

(22) Filed: May 16, 2011

(65) Prior Publication Data

US 2013/0235586 A1 Sep. 12, 2013

Related U.S. Application Data

(63) Continuation-in-part of application No. 13/128,945, filed as application No. PCT/IB2009/055020 on Nov. 12, 2009, now Pat. No. 8,314,537.

(30) Foreign Application Priority Data

Nov. 18, 2008 (EP) ..... 08169325

(51) Int. Cl.

| | |
|---|---|
| ***H01J 1/02*** | (2006.01) |
| ***H01J 7/24*** | (2006.01) |
| ***H01J 61/52*** | (2006.01) |
| ***H01K 1/58*** | (2006.01) |
| ***F21K 99/00*** | (2010.01) |
| ***F21V 29/00*** | (2006.01) |
| *F21V 23/06* | (2006.01) |
| *F21V 3/02* | (2006.01) |
| *F21Y 101/02* | (2006.01) |

(52) U.S. Cl.

CPC ..... *F21K 9/10* (2013.01); *F21V 29/20* (2013.01)*F21V 23/06* (2013.01); *F21V 3/02* (2013.01); ; *F21K 9/1355* (2013.01); *F21Y 2101/02* (2013.01); *F21V 29/2293* (2013.01); *F21V 19/055* (2013.01)

USPC ..... 313/46; 366/373; 366/249.02

(58) Field of Classification Search

USPC ..... 362/249.01, 249.02, 311.01, 311.02, 362/341, 345, 373, 800

See application file for complete search history.

(56) References Cited

U.S. PATENT DOCUMENTS

| | | | | |
|---|---|---|---|---|
| 5,806,965 | A | 9/1998 | Deese | |
| 6,525,668 | B1 | 2/2003 | Petrick | |
| 2004/0195947 | A1 * | 10/2004 | Clark et al. | 313/46 |
| 2004/0202005 | A1 | 10/2004 | Moisel | |
| 2005/0092469 | A1 | 5/2005 | Huang | |

FOREIGN PATENT DOCUMENTS

| | | | |
|---|---|---|---|
| DE | 202004013773 | U1 | 12/2004 |
| EP | 1047903 | B1 | 6/2007 |
| WO | 2010136920 | A1 | 12/2010 |

OTHER PUBLICATIONS

LEDs Magazine, "Philips first to submit L Prize entry", http://www.ledsmagazine.com/news/6/9/24, Sep. 2009, pp. 1-2, Tulsa, Oklahoma.

(Continued)

*Primary Examiner* — Donald Raleigh

(74) *Attorney, Agent, or Firm* — Yuliya Mathis

(57) ABSTRACT

Disclosed is an LED-based bulb-type lamp, including a cooling structure and a plurality of LEDs thermally connected to the cooling structure. The lamp includes at least three separate LED arrays oriented substantially parallel to its central longitudinal axis, such that the LEDs are interspersed among a plurality of light-transmission sub-areas of the LED-based lamp. One or more portions of the cooling structure of the lamp extend to its outer surface, as assembled, such that light-transmissive and heat-dissipating areas are spread over the outer surface, for example, in an alternating manner.

23 Claims, 18 Drawing Sheets

(56) References Cited

OTHER PUBLICATIONS

Home Depot, "Philips 12 watt (60W equivalent) A19 Ambient LED Soft White Light Bulb Dimmable", http://www.homedepot.com/Electrical-Light-Bulbs-LED/h_d1/N-5yc1vZbm79/R-202530170/h_d2/ProductDisplay?langId=-1&storeId=10051&catalogId=10053 (2010). pp. 1-3 (last accessed on May 16, 2011).

* cited by examiner

LED-BASED ELECTRIC LAMP

CROSS-REFERENCE TO RELATED APPLICATIONS

This application is a continuation-in-part of U.S. patent application Ser. No. 13/128,945, which is a national stage application under 35 U.S.C. §371 of International Application No. PCT/IB2009/055020, filed on Nov. 12, 2009, and incorporated herein by reference.

TECHNICAL FIELD

The present invention is directed generally to an electric lamp. More particularly, various inventive methods and apparatus disclosed herein relate to a bulb type LED-based electric lamp.

BACKGROUND

Illumination devices based on semiconductor light sources, such as light-emitting diodes (LEDs), offer a viable alternative to traditional fluorescent, HID, and incandescent lamps. Functional advantages and benefits of LEDs include high energy conversion and optical efficiency, durability, lower operating costs, and many others. Recent advances in LED technology have provided efficient and robust lighting units that enable general illumination, as well as a variety of lighting effects in many applications. Some of these lighting units employ two or more groups or "channels" of LEDs which produce light of different colors, each controllably supplied with the predetermined current to enable generation and mixing of light to produce general illumination with desired attributes or a desired lighting effect.

Some of the known LED-based approaches for replacing incandescent light bulbs have a number of shortcomings. For example, one such lamp, shown in FIG. 1A, has a bulb mounted on a socket. A light source, comprising a plurality of LEDs mounted on a PCB, is arranged inside the bulb. The PCB is provided with venting holes that function as cooling means (not shown). A part of the PCB is formed as a base plate on which the bulb, embodied as a protective dome, is mounted, said dome surrounding the light source and parts of the PCB and the cooling means. The dome has a translucent outer surface for transmitting light originating from the light source during operation of the lamp. A lamp axis extends through a central end of the socket and a central extremity of the bulb. The desired omnidirectional light distribution of this lamp is impeded by the base plate on which the dome is mounted. Furthermore, disposing the protective dome over the PCBs and LEDs compromises heat dissipation.

Referring to FIG. 1B, another known LED-based alternative to incandescent light bulbs, particularly A55 and A60 types, is a MASTER LEDbulb available from Koninklijke Philips Electronics N.V., featuring a plurality of LED light sources disposed over a heat sink and emitting dimmable light towards a diffusing dome cover.

Recently, legislation has been enacted to spur development of ultra-efficient solid-state lighting products to replace the common light bulb. The legislation challenges industry to develop viable replacement technologies for two of today's most widely used and inefficient technologies –60 W incandescent lamps and PAR 38 halogen lamps.

Accordingly, it would be desirable to provide an improved lighting device employing LED light sources, optionally addressing one or more of the drawbacks of conventional technologies, while providing quality illumination with high color rendering. It is also desirable for this lighting device to optionally substantially retain commonly encountered form factors, so that existing hardware, sockets, and power connections could be employed, thereby further reducing costs and reducing waste associated with retooling, and facilitating adoption of this improved LED-based electric lamp.

SUMMARY

The present disclosure is related to inventive methods and apparatus for energy-efficient LED-based lamps. For example, LED-based lamps disclosed herein may have standard form factors, so that they may be used with existing lighting hardware. More particularly, various embodiments of the present disclosure are directed to high-output LED-based lamps suitable for replacement of conventional sources, in terms of size, shape, operating environment, and/or light quantity, distribution, and/or quality.

Generally, in one aspect, an LED-based lamp includes a socket surrounding a longitudinal lamp axis. The lamp also includes cooling structure having a plurality of substantially planar surfaces radially arranged about the lamp axis and a plurality of protruding portions. Each of the protruding portions is positioned between two of the surfaces and extends outward and away from the lamp axis and each of the surfaces. Each of the surfaces is substantially parallel to the lamp axis. The lamp also includes a plurality of LED PCBs, driving electronics, and a plurality of light transmittable caps. Each of the LED PCBs is coupled to a single of the surfaces. The driving electronics are substantially enclosed within the cooling structure and are electrically coupled to each of the LED PCBs and to the socket. The light transmittable caps are each positioned over a single of the LED PCBs and each extends between two adjacent of the protruding portions.

In some embodiments, the lamp further includes a plurality of thermal pads each interposed between a single of the LED PCBs and a single of the surfaces. The lamp may further include a plurality of reflectors each placed over a single of the LED PCBs and containing at least one LED opening therein. In some version of those embodiments each of the reflectors includes a pair of side extensions each covering at least some of a single of the protruding portions.

In some embodiments, the protruding portions include a longitudinally extending cooling channel therein. In some versions of those embodiments, the cooling channel extends below the light transmittable caps in a direction toward the socket. The periphery of the protruding portions may optionally generally conform to the periphery of the light transmittable caps.

Generally, in another aspect, an LED-based lamp includes a socket surrounding a longitudinal lamp axis and a cooling structure having a plurality of protruding portions and a plurality of light-transmission sub-areas. The light-transmission sub-areas are each generally defined between a pair of the protruding portions. The protruding portions and the light-transmission sub-areas are arranged about the lamp axis in an alternating configuration. The lamp also includes a plurality of LED arrays, driving electronics, and a plurality of light transmittable caps. Each of the LED arrays is retained within a single of the light-transmission sub-areas. The driving electronics are substantially enclosed within the cooling structure and are electrically coupled to each of the LED arrays and to the socket. Each of the caps covers a single of the light transmission sub-areas. The periphery of the light transmittable caps may optionally substantially conform to the periphery of the protruding portions.

In some embodiments the LED arrays each include a flexible electrical connection member electrically coupled thereto and electrically coupled to the driving electronics. In some version of those embodiments an interconnection PCB is electrically interposed between the flexible electrical connection member and the driving electronics. The interconnection PCB may optionally be accessible via at least one electrical connection opening through the cooling structure that is near an end of the LED-based lamp distal the socket.

In some embodiments, the light transmission sub-areas are all substantially the same size. In some versions of those embodiments, the number of the light transmission sub-areas is from two to four.

In some embodiments, the lamp further includes a plurality of reflectors each placeable over a single of the LED arrays and containing at least one LED opening therein. In some versions of those embodiments each of the LED arrays includes a LED PCB compressed between a single of the reflectors and the cooling structure.

Generally, in another aspect, an LED-based lamp includes a socket surrounding a lamp axis, driving electronics electrically coupled to the socket, and at least three interconnection connection members each electrically coupled to the driving electronics. A cooling structure is also provided and surrounds the interconnection connection members and at least partially surrounds the driving electronics. The cooling structure has a plurality of interspersed light-transmission sub-areas arranged about the lamp axis. A plurality of LED arrays are each retained within a single of the light-transmission sub-areas. A plurality of flexible electrical connection members are each electrically and physically coupled to a single of the LED arrays and electrically and physically coupled to a single of the interconnection connection members. The flexible electrical connection members each extend through a single of a plurality of pathways through the cooling structure.

In some embodiments, each of the pathways is a recess atop the cooling structure enclosed with a top cover installed thereover.

In some embodiments, the interconnection connection members are all coupled to an interconnection PCB. Also, each recess may retain an extension extending from a light-transmissive cap provided across a single of the light-transmission sub-areas.

Generally, in another aspect, an LED-based lamp includes a socket surrounding a lamp axis, driving electronics electrically coupled to the socket, and at least three interconnection connection members electrically coupled to the driving electronics and positioned more distal the socket than a majority of the driving electronics are to the socket. A cooling structure is also provided that surrounds the interconnection connection members and at least partially surrounding the driving electronics. The cooling structure has a plurality of interspersed light-transmission sub-areas arranged about the lamp axis. The lamp also includes a plurality of LED arrays each retained within a single of the light-transmission sub-areas and a plurality of flexible electrical connection members each electrically and physically coupled to a single of the LED arrays and electrically and physically coupled to a single of the interconnection connection members. The flexible electrical connection members each extend through a single of a plurality of recesses atop the cooling structure. The recesses are enclosed by a top cover installed thereover and coupled to the cooling structure.

In some embodiments, the interconnection connection members are all coupled to an interconnection PCB.

In some embodiments, the lamp further includes a plurality of light-transmissive caps each provided across a single of the light-transmission sub-areas.

In some embodiments, the light-transmissive caps each include an extension extending through a single of the recesses.

In some embodiments, the lamp further includes a plurality of reflectors each placeable over a single of the LED arrays and containing at least one LED opening therein. In some versions of those embodiments the reflectors each include an extension extending through a single of the recesses. In some versions of those embodiments each of the LED arrays includes a LED PCB compressed between a single of the reflectors and the cooling structure. The lamp may further include a plurality of thermal interface pads each interposed between a single LED PCB and the cooling structure.

Implementing various inventive concepts disclosed herein, these LED-based lamps efficiently integrate compact power supply and control components for driving high-intensity LEDs together with thermal management and optical systems, providing for a form and function fit equivalent to common general-purpose incandescent light bulbs, for example, an A19 bulb in accordance with ANSI C78.20-2003, with a single contact medium screw base E26/24. Furthermore, LED-based lamps according to various embodiments disclosed herein contemplate producing a substantially omnidirectional pattern of light distribution with dimming ability.

As used herein for purposes of the present disclosure, the term "LED" should be understood to include any electroluminescent diode or other type of carrier injection/junction-based system that is capable of generating radiation in response to an electric signal. Thus, the term LED includes, but is not limited to, various semiconductor-based structures that emit light in response to current, light emitting polymers, organic light emitting diodes (OLEDs), electroluminescent strips, and the like. In particular, the term LED refers to light emitting diodes of all types that may be configured to generate radiation in one or more of the infrared spectrum, ultraviolet spectrum, and various portions of the visible spectrum (generally including radiation wavelengths from approximately 400 nanometers to approximately 700 nanometers). It also should be appreciated that LEDs may be configured and/or controlled to generate radiation having various bandwidths (e.g., full widths at half maximum, or FWHM) for a given spectrum (e.g., narrow bandwidth, broad bandwidth), and a variety of dominant wavelengths within a given general color categorization.

For example, one implementation of an LED configured to generate essentially white light (e.g., a white LED) may include a number of dies which respectively emit different spectra of electroluminescence that, in combination, mix to form essentially white light. In another implementation, a white light LED may be associated with a phosphor material that converts electroluminescence having a first spectrum to a different second spectrum. In one example of this implementation, electroluminescence having a relatively short wavelength and narrow bandwidth spectrum "pumps" the phosphor material, which in turn radiates longer wavelength radiation having a somewhat broader spectrum.

It should also be understood that the term LED does not limit the physical and/or electrical package type of an LED. For example, as discussed above, an LED may refer to a single light emitting device having multiple dies that are configured to respectively emit different spectra of radiation (e.g., that may or may not be individually controllable). Also, an LED may be associated with a phosphor that is considered as an integral part of the LED (e.g., some types of white LEDs). In general, the term LED may refer to packaged LEDs, non-packaged LEDs, surface mount LEDs, chip-on-board LEDs, T-package mount LEDs, radial package LEDs, power package LEDs, LEDs including some type of encasement and/or optical element (e.g., a diffusing lens), etc.

The term "light source" should be understood to refer to any one or more of a variety of radiation sources, including, but not limited to, LED-based sources (including one or more LEDs as defined above).

The term "color temperature" generally is used herein in connection with white light, although this usage is not intended to limit the scope of this term. Color temperature essentially refers to a particular color content or shade (e.g., reddish, bluish) of white light. The color temperature of a given radiation sample conventionally is characterized according to the temperature in degrees Kelvin (K) of a black body radiator that radiates essentially the same spectrum as the radiation sample in question. Black body radiator color temperatures generally fall within a range of from approximately 700 degrees K (typically considered the first visible to the human eye) to over 10,000 degrees K; white light generally is perceived at color temperatures above 1500-2000 degrees K. Lower color temperatures generally indicate white light having a more significant red component or a "warmer feel," while higher color temperatures generally indicate white light having a more significant blue component or a "cooler feel."

The terms "lighting unit" or "lighting device" is used herein to refer to an apparatus including one or more light sources of same or different types. A given lighting unit may have any one of a variety of mounting arrangements for the light source(s), enclosure/housing arrangements and shapes, and/or electrical and mechanical connection configurations. Additionally, a given lighting unit optionally may be associated with (e.g., include, be coupled to and/or packaged together with) various other components (e.g., control circuitry) relating to the operation of the light source(s). The term "LED-based lighting device" refers to a lighting unit that includes one or more LED-based light sources as discussed above, alone or in combination with other non LED-based light sources. A "multi-channel" lighting unit refers to an LED-based or non LED-based lighting unit that includes at least two light sources configured to respectively generate different spectrums of radiation, wherein each different source spectrum may be referred to as a "channel" of the multi-channel lighting unit.

According to certain embodiments, the first channel includes a first plurality of white LEDs in series with each other, and the second channel includes a second plurality of red LEDs (e.g., two LEDs) in series with each other. A desired color temperature of the light may be controlled by adjusting the current through the two channels. For example, in many embodiments, the currents through the channels are controlled such that the essentially white light generated by the lamp has a correlated color temperature in the range from approximately 2700K to 3000K with a Color Rendering Index (CRI) exceeding 90.

A given light source may be configured to generate electromagnetic radiation within the visible spectrum, outside the visible spectrum, or a combination of both. Hence, the terms "light" and "radiation" are used interchangeably herein. Additionally, a light source may include as an integral component one or more filters (e.g., color filters), lenses, or other optical components. Also, it should be understood that light sources may be configured for a variety of applications, including, but not limited to, indication, display, and/or illumination. An "illumination source" is a light source that is particularly configured to generate radiation having a sufficient intensity to effectively illuminate an interior or exterior space. In this context, "sufficient intensity" refers to sufficient radiant power in the visible spectrum generated in the space or environment (the unit "lumens" often is employed to represent the total light output from a light source in all directions, in terms of radiant power or "luminous flux") to provide ambient illumination (i.e., light that may be perceived indirectly and that may be, for example, reflected off of one or more of a variety of intervening surfaces before being perceived in whole or in part).

The term "spectrum" should be understood to refer to any one or more frequencies (or wavelengths) of radiation produced by one or more light sources. Accordingly, the term "spectrum" refers to frequencies (or wavelengths) not only in the visible range, but also frequencies (or wavelengths) in the infrared, ultraviolet, and other areas of the overall electromagnetic spectrum. Also, a given spectrum may have a relatively narrow bandwidth (e.g., a FWHM having essentially few frequency or wavelength components) or a relatively wide bandwidth (several frequency or wavelength components having various relative strengths). It should also be appreciated that a given spectrum may be the result of a mixing of two or more other spectra (e.g., mixing radiation respectively emitted from multiple light sources).

For purposes of this disclosure, the term "color" is used interchangeably with the term "spectrum." However, the term "color" generally is used to refer primarily to a property of radiation that is perceivable by an observer (although this usage is not intended to limit the scope of this term). Accordingly, the terms "different colors" implicitly refer to multiple spectra having different wavelength components and/or bandwidths. It also should be appreciated that the term "color" may be used in connection with both white and non-white light.

The term "controller" is used herein generally to describe various apparatus relating to the operation of one or more light sources. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASICs), and field-programmable gate arrays (FPGAs).

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

Figure 1A:
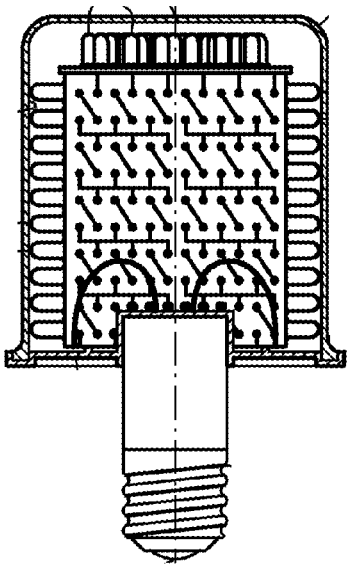
FIG. 1A (PRIOR ART)
FIG. 1A illustrates a LED-based lamp according to the prior art.
Figure 1B:
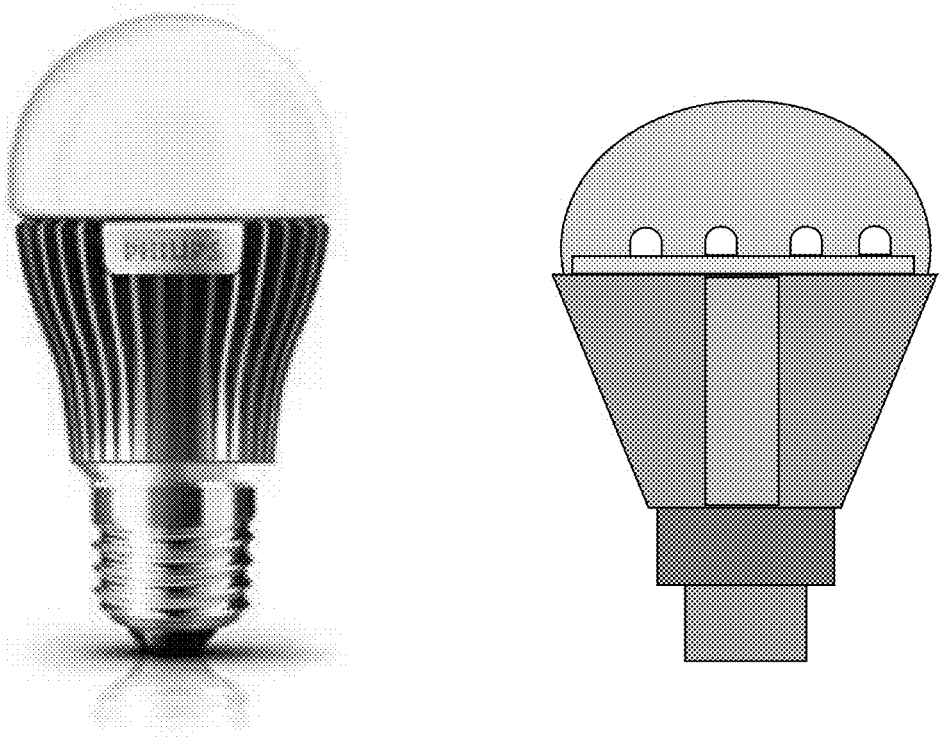
FIG. 1B PRIOR ART
FIG. 1B Illustrates another LED-based lamp according to the prior art.

Known LED-based approaches for replacing incandescent light bulbs have a number of shortcomings. For example, in one approach desired omnidirectional light distribution is impeded by a horizontal base plate upon which the LEDs are mounted. Moreover, in such an approach a protective dome that surrounds the LEDs compromises heat dissipation. Recent legislation has challenged industry to develop improved LED-based approaches for replacing incandescent bulbs.

Accordingly, it would be desirable to provide an improved lighting device employing LED light sources, optionally addressing one or more of the drawbacks of conventional technologies, while providing quality illumination with high color rendering. More generally, Applicants have recognized and appreciated that it would be beneficial to provide an LED-based lamp that may optionally retain commonly encountered form factors.

In view of the foregoing, various embodiments and implementations of the present invention are directed to an LED-based electric lamp.

In some embodiments, the LED-based lamps contemplated herein deliver a total luminous flux greater than 600 lumens, and, in some specific embodiments, greater than 900 lumens, while consuming 10 Watts of electric energy or less. As discussed in more detail below, the lamps may have an even distribution of luminous intensity within the 0° to 150° axially symmetrical area. Preferably, luminous intensity at any angle within this zone shall not differ from the mean luminous intensity for the entire 0° to 150° zone by more than 10%.

One aspect of the present disclosure generally relates to orienting at least three separate LED arrays substantially parallel to a central longitudinal axis of the device by, for example, disposing them on PCBs attached to surfaces of a heat sink. Another aspect focuses on extending one or more portions of the heat sink to the outer surface of the device, as assembled, such that its light-transmissive and heat-dissipating areas are spread over the outer surface, for example, in an alternating manner. Such configuration of the heat sink increases the surface area exposed to the ambient atmosphere, and hence increases and improves the heat dissipating capacity of the device, with little or no increase in the size or weight of the device. Thus, in some embodiments, the light-transmitting surface of the device is divided into sub-areas by the extended portions of the heat sink. As a result, the light distribution may be tuned, for example, via setting the orientation and configuration of sub-areas of the light-transmitting surface and associated arrays of LEDs. In other embodiments, the light distribution may be controlled via control of the intensity of the arrays of LEDs, and/or possibly even within arrays the intensity of individual LEDs may be controlled. By setting the orientation and/or intensity of the illumination from individual sub-areas, the lamp may achieve an equal luminous intensity, as perceived by an observer, within a space angle of 300° (i.e. the equal luminous intensity is observed from all directions except from directions within a cone around the socket and having its apex inside the bulb on the axis, with the cone having an apex angle of) 60°. Equal luminous intensity in this respect means an average light intensity with a variation in light intensity of plus or minus 10-15%.

Figure 2A:
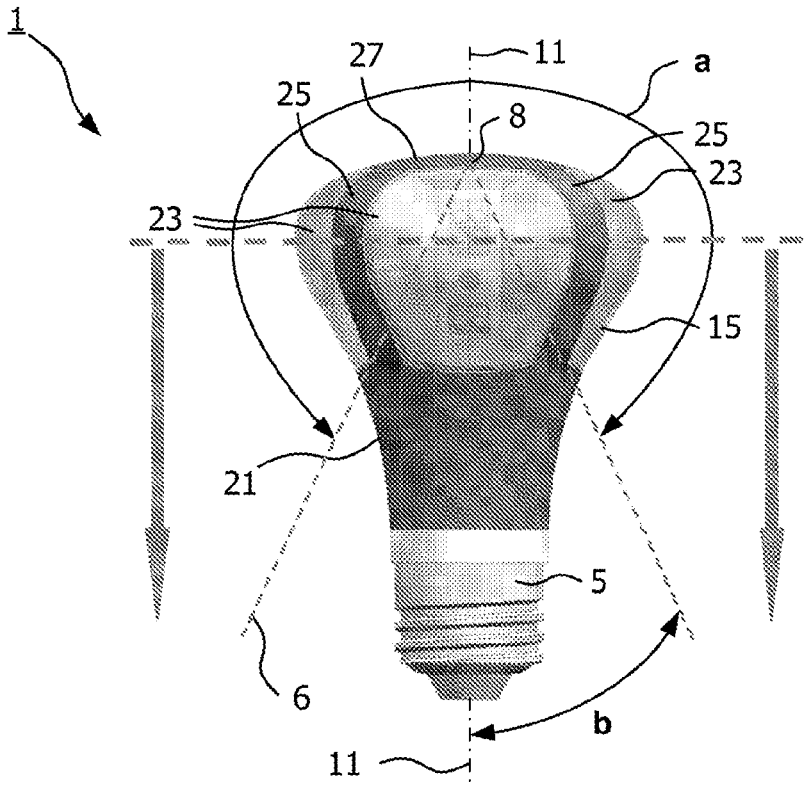
FIG. 2A illustrates a side view of a first embodiment of a LED-based lamp.
Figure 2B:
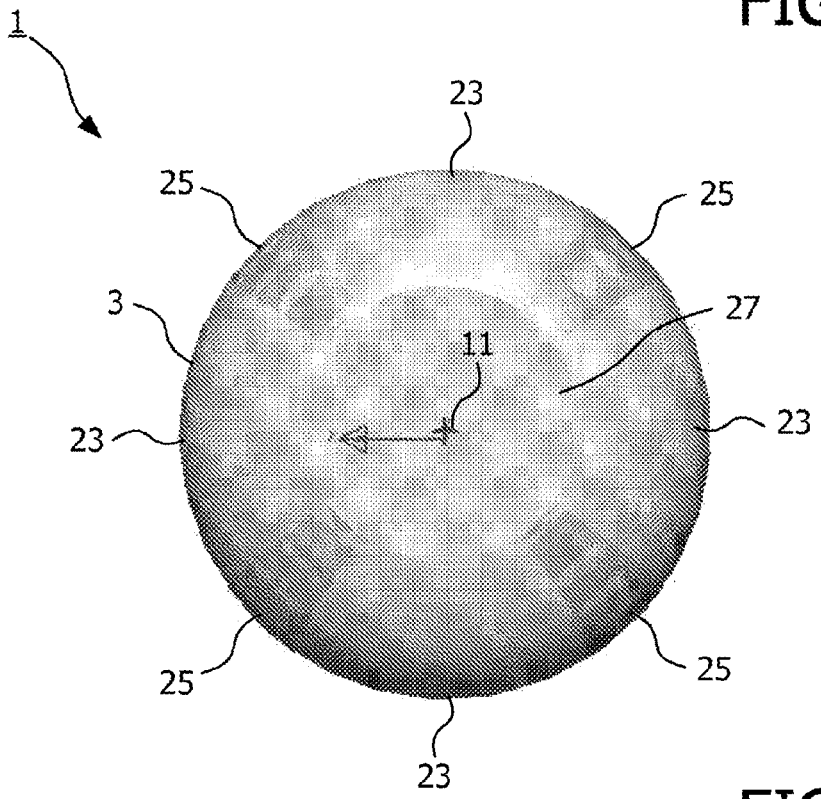
FIG. 2B shows a top view of the LED-based lamp of FIG. 2A.

Referring to FIG. 2A a side view of a first embodiment of a LED-based lamp 1 is shown. The lamp 1 has a socket 5, an E27 Edison fitting, in which the bulb 3 comprising cooling means 21 is mounted. The outer surface 15 of bulb 3 is formed both by light transmittable surface sub-areas 23, four arches 25 (of which only two are shown) and an adjoining top 27 of the cooling means, which feature is more clearly visible in the top view shown in FIG. 2B along axis 11. The cooling means 21 extend from inside the bulb into the outer surface of the bulb and are formed as solid arches. In the embodiment of FIG. 2A, surfaces are mutually flush at locations at the outer surface of the bulb where said surfaces of both the cooling means and the light transmittable sub-areas border each other. The cooling means hamper only to a small extent the distribution of light as emitted by the light source (not shown) through the light transmittable surface 15, and to a significantly lesser degree than the prior art lamp as shown in FIG.

Figure 2C:
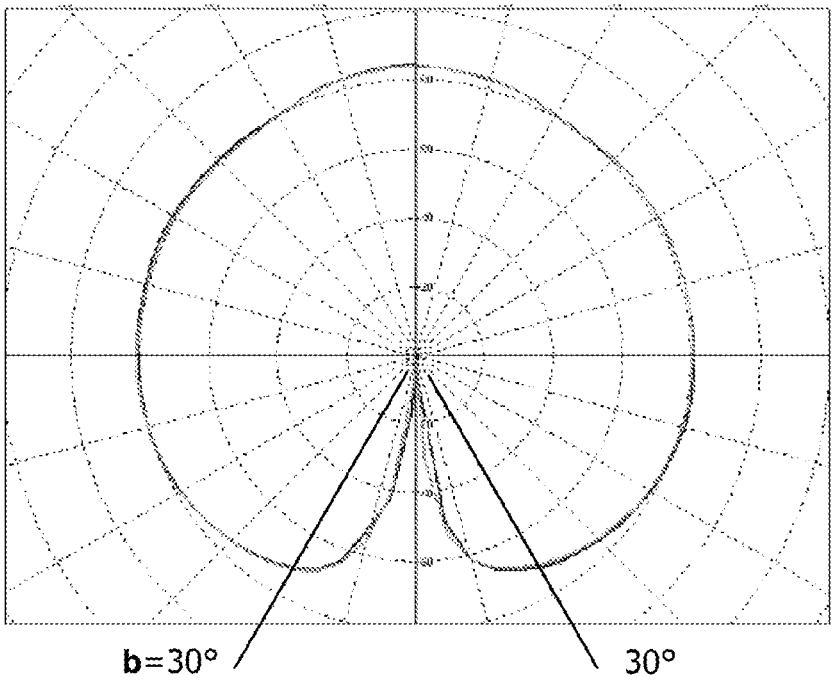
FIG. 2C shows a light distribution of the LED-based lamp of FIG. 2A.

1B. The spatial light intensity distribution of the lamp of FIG. 2A as a function of the angle β is shown in FIG. 2C. In the plot shown in FIG. 2C, the angle B=0° refers to the light intensity as measured along the axis 11 in the direction from socket 5 towards bulb 3.

Figure 2D:
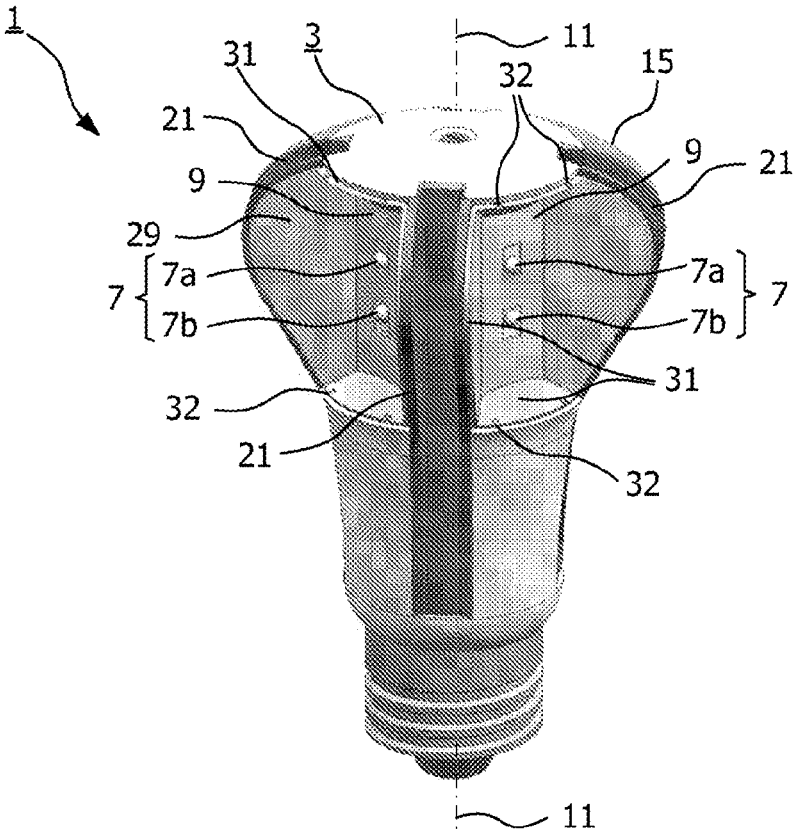
FIG. 2D shows a perspective view, partly broken away, of a second embodiment of a LED-based lamp.

In FIG. 2D a perspective view, partly broken away, of a second embodiment of the lamp 1 is shown, i.e. the light transmittable sub-areas are formed by releasably fixed light transmittable parts, of which two are left out, which light transmittable parts are provided with click/snap elements enabling easy assembly onto the lamp by interconnecting with clicking elements 32 provided on the cooling means 21. Some of the components inside the bulb 3 are visible, including the light source 7 which is made up of a plurality of LEDs 7*a*, 7*b* mounted on a PCB 9, and cooling means 21 which extend from the PCBs inside the bulb into the outer surface 15 of the bulb. The PCBs 9 are arranged around axis 11. The cooling means are shaped as recesses extending from the bulb outer surface towards the axis and are coated on a side 29 facing the LEDs with a reflective coating 31 to counteract light losses due to absorption of light by the cooling means and thus to increase the efficiency of the lamp. Each PCB and subgroups of LEDs is proximate to its respective cooling means, and as a result a relatively very efficient cooling is obtained. The LEDs can comprise: —a combination of Red, Green, Blue, White (RGBW) LEDs, —RGBW—Amber LEDs, —LEDs of different color temperature, —LEDs which are all of the same color, or Blue/UV-LEDs in combination with a remote phosphor provided on or in the light transmittable parts. In the lamp of FIG. 2D the LEDs are of different color temperature, i.e. 2500K and 7000K, of which the emission intensity can be controlled independently to adjust the emitted color temperature of the lamp.

Figure 3A:
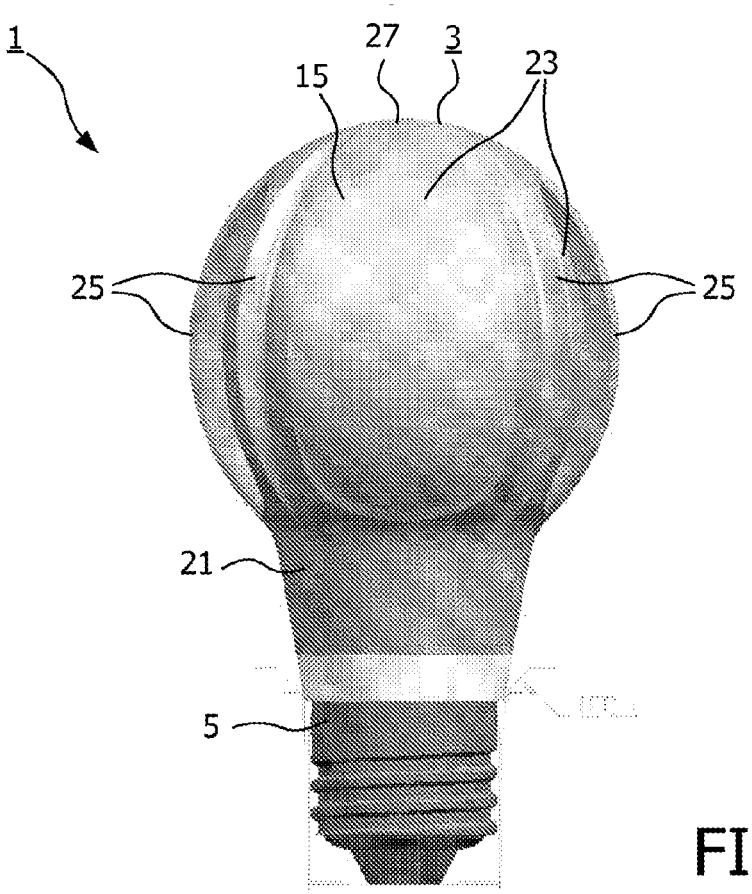
FIG. 3A shows a side view of a third embodiment of a LED-based lamp.
Figure 3B:
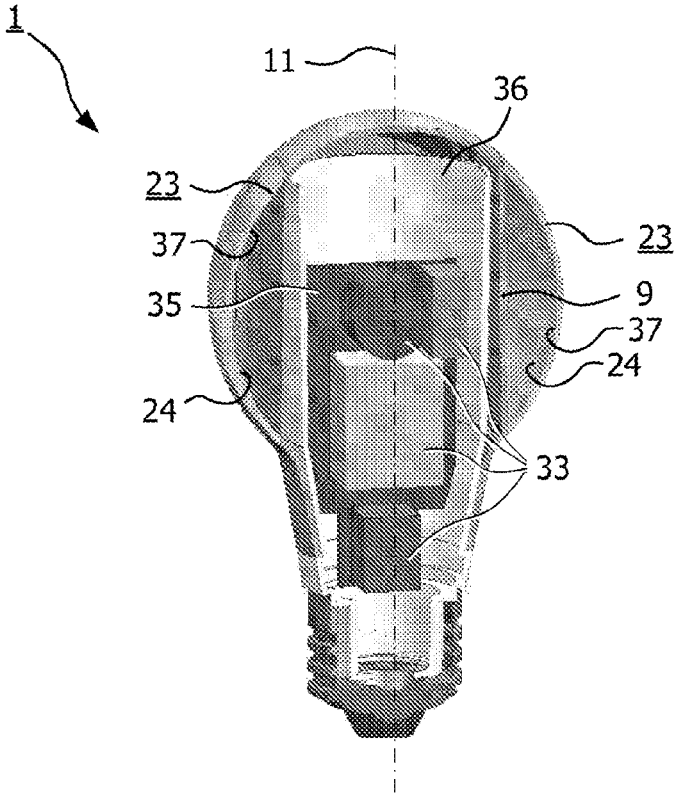
FIG. 3B shows a vertical cross-section of the LED-based lamp of FIG. 3 A.

FIG. 3A shows a side view of a third embodiment of a lamp 1. The lamp 1 has a socket 5, an E27 Edison fitting, in which the bulb 3 comprising cooling means 21 is mounted. The outer surface 15 of the bulb is formed both by six light transmittable surface sub-areas 23 of the same shape, six corrugated arches 25 (of which only four are shown) and an adjoining top 27 of the cooling means. In the lamp of FIG. 3A the light transmittable sub-areas each are surrounded by respective cooling means. The cooling means are not flush with the light transmittable surface but are partly laid over said surface, such that the cooling means together with the light transmittable surface form an undulated bulb outer surface. The cooling means in this lamp do not extend from inside the bulb into and beyond the outer surface 15 of the bulb, but only form part of the bulb outer surface. FIG. 3B shows a vertical cross-section of the lamp 1 of FIG. 3 A. As the lamp is a DC lamp, an electronic driver circuit 33 is provided inside a cavity 35 in the bulb 3 which converts the alternating mains voltage into an appropriate DC voltage. The cavity 35 has an annular outer wall formed by the PCBs 9 of heat conducting material around the axis 11, and thus acts as a cooling means, on which PCBs the LEDs (not shown) are (to be) mounted, the six arches being thermally connected to said wall at the bulb outer surface, and an electrically insulating wall 36 shielding the driver from the PCBs. Thus, efficient cooling of both the LEDs and the driver circuit is obtained. The lamp of FIG. 3B comprises Blue-LEDs whose radiation is converted into visible light by a remote phosphor YAG-Ce coating 37 which is provided on an inner surface 24 of the light transmittable sub-areas 23.

Figure 4:
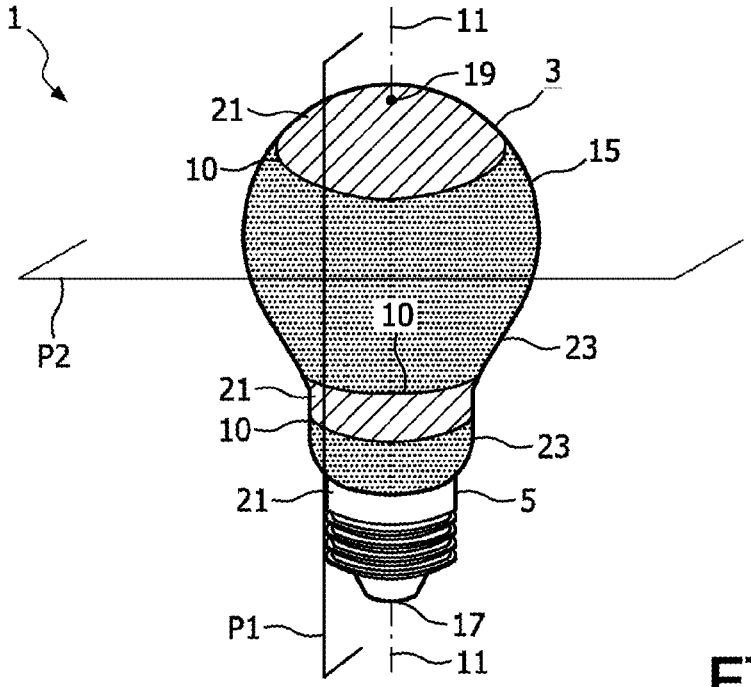
FIG. 4 shows a fourth embodiment of a LED-based lamp.
Figure 5:
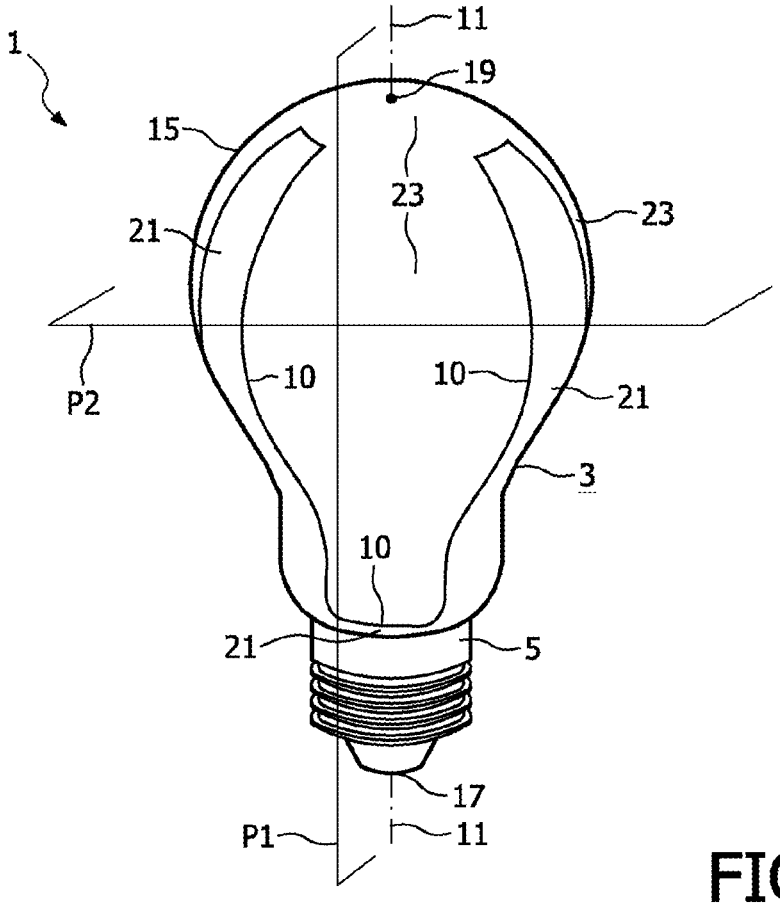
FIG. 5 shows a fifth embodiment of a LED-based lamp.
Figure 6:
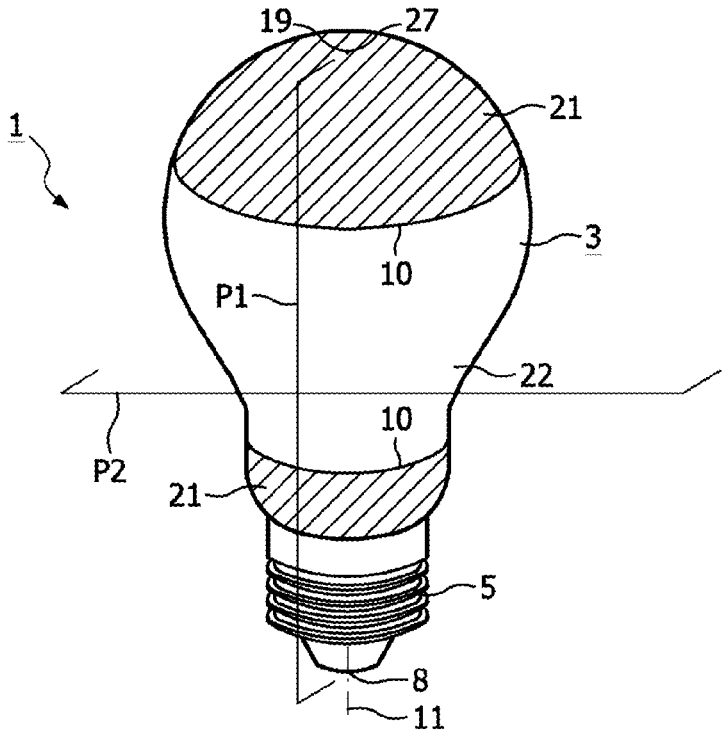
FIG. 6 shows a sixth embodiment of a LED-based lamp.
Figure 7:
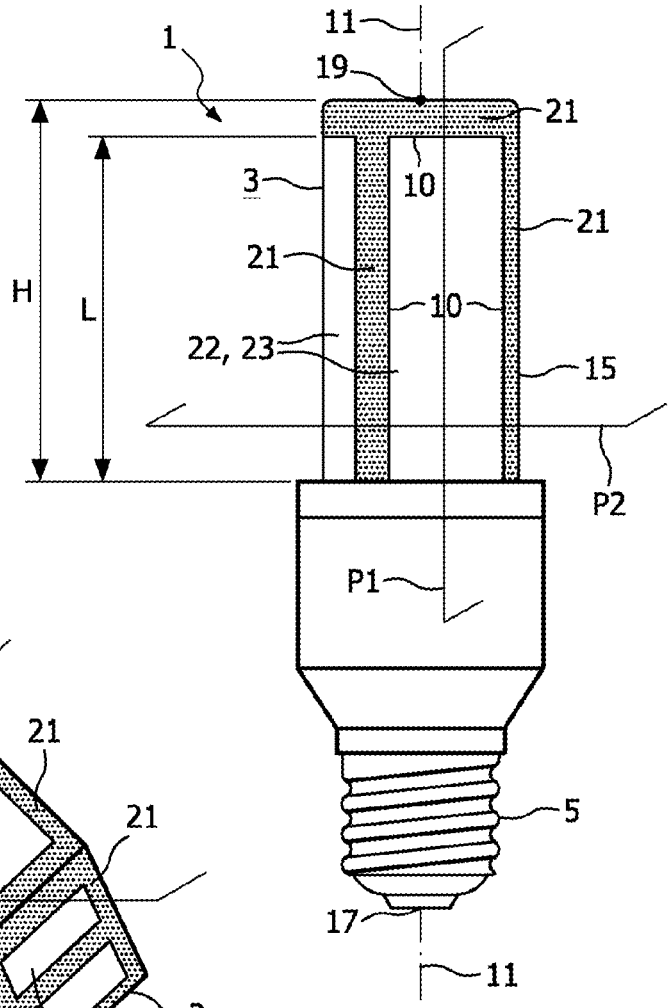
FIG. 7 shows a seventh embodiment of a LED-based lamp.
Figure 8:
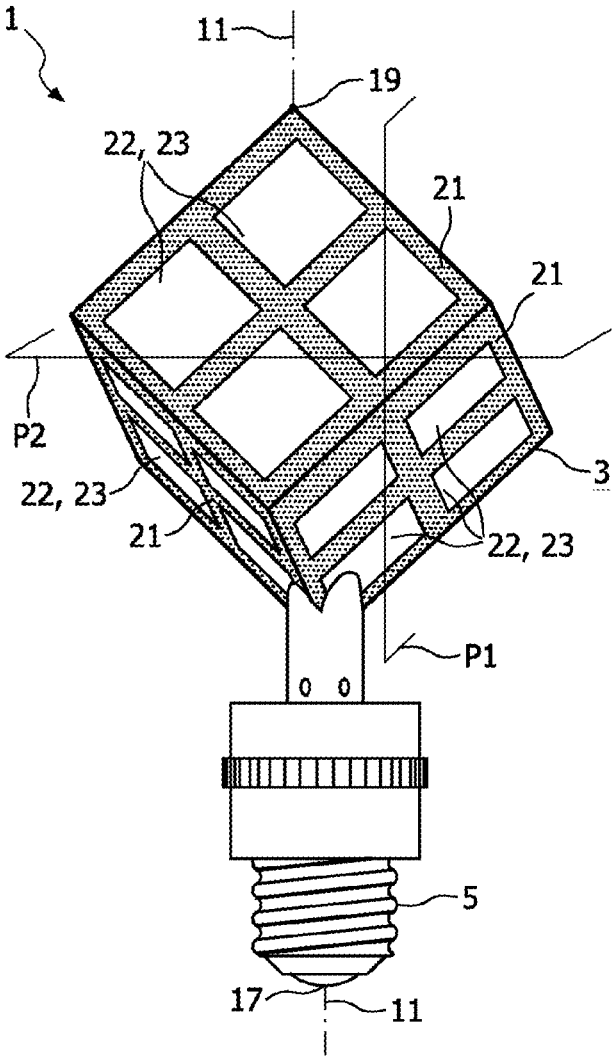
FIG. 8 shows an eighth embodiment of a LED-based lamp.

FIG. 4 to FIG. 8, respectively, show a fourth, a fifth, a sixth, a seventh and an eighth embodiment of a lamp 1 in which on the outer surface 15 of the bulb 3 alternative arrangements of cooling means 21 and light transmittable sub-areas 23 are shown. The lamp in FIG. 4 has parallel annular rings of cooling means; the lamp in FIG. 5 has an interdigitated (finger-like or comb-like mean) cooling mean 21 with the light transmittable sub-areas 23. Three finger-like cooling areas form an interdigitated mean with three sub-areas of the light transmittable surface. The lamp 1 in FIG. 6 shows an embodiment in which the cooling means 21 are arranged adjacent the socket 5 and at the top 27 of the lamp comprising one integral light transmittable surface 22, i.e. without intermediate sub-areas. FIGS. 7 and 8 show alternative embodiments of the shape of the bulb, i.e. in FIG. 7 the bulb is tube-shaped and in FIG. 8 the bulb is a six-sided polygon (hexagon) with a patched mean formed by the cooling means and the sub-areas 23 of the light transmittable surface 22. Furthermore, in each of said FIGS. 4 to 8, a plane P1 parallel to an axis 11 is shown as well as a plane P2 perpendicular to said axis. The axis 11 extends through an end 17 of a socket 5 and an extremity 19 of bulb 3. In all the embodiments shown in FIGS. 4 to 8 at least one plane, either plane P1 or plane P2 or both plane P1 and plane P2, crosses two or more times a boundary 10 between the cooling means 21 and the light transmittable surface 22 or sub-areas 23 thereof. In FIG. 4 plane P1 crosses said boundary three times, and plane P2 crosses no boundary 10. In FIG. 5 plane P1 crosses no boundary while plane P2 crosses said boundary 10 six times. In FIG. 6 Plane P1 crosses said boundary two times, and Plane P2 crosses no boundary 10. In FIG. 7 Plane P1 crosses said boundary 10 one time, and Plane P2 crosses said boundary six times. In FIG. 8 both Plane P1 and Plane P2 cross said boundary 10 eight times. In the lamp of FIG. 7 the bulb outer surface 15 has an interdigitated mean of the cooling means 21 and the sub-areas 23 of the light transmittable surface 22. The interdigitated mean extends in axial direction over a length L over the bulb outer surface 15. Preferably the length L should be at least ¼ of an axial height H of the bulb 3.

Figure 9:
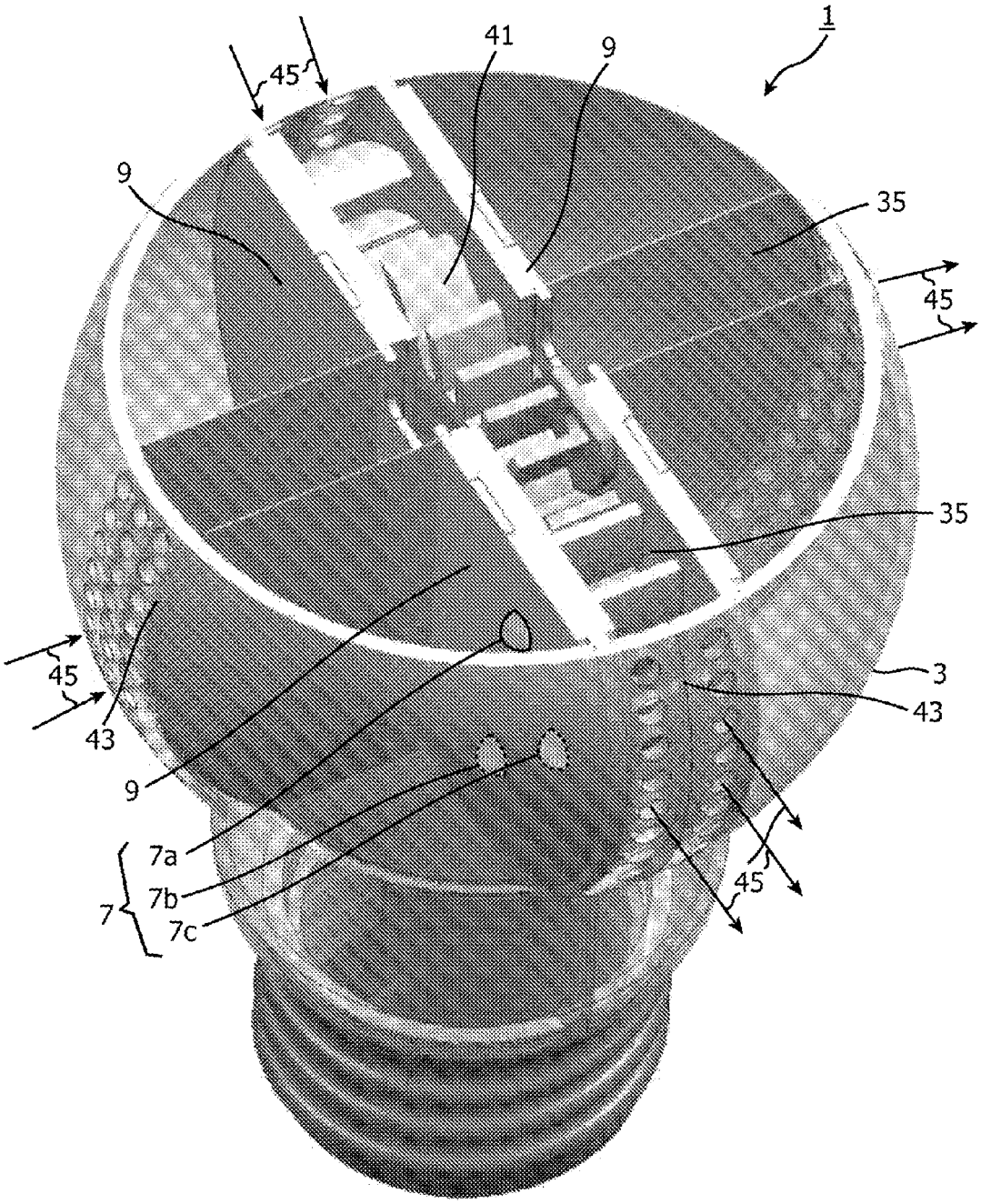
FIG. 9 shows a ninth embodiment of a LED-based lamp.

FIG. 9 shows a vertical cross-section of a ninth embodiment of the lamp 1. The lamp is both an actively cooled and passively cooled lamp. Active cooling means 41, in the Figure a double fan working in two, transverse directions, is provided inside a cavity 35 in the bulb 3 which enhances the cooling capacity of and control of the cooling of the lamp. Grates 43 are provided to enable forced flow of air, indicated by arrows 45, through the cavity. The cavity 35 has an outer wall formed by the PCBs 9 of heat conducting material, which thus acts as a passive cooling means, on which the LEDs 7*a*, 7*b*, 7*c* are mounted. Thus, efficient cooling of the lamp is obtained.

Referring to FIGS. 10-17, various aspects of a tenth embodiment of a LED-based lamp 101 is illustrated. The LED-based lamp 101 includes three separate LED PCBs 109, each containing red and blue LEDs 107. One or more thermal sensors may optionally be mounted on each LED PCB 109 and utilized to maintain a desired balance between the amounts of red and blue light. In some embodiments each PCB 109 contains 2-4 red LEDs and 2-4 blue LEDs. For example, in one embodiment each PCB 109 contains 3 red Phoenix LEDs available from Epistar (emitting at approximately 614 nm) and 3 blue Rebel LEDs available from Philips Lumileds (emitting at approximately 452-480 nm). In some embodiments, the PCBs 109 may be formed from a ceramic material selected to have its thermal expansion coefficient substantially matching that of the LEDs 107 to improve reliability of the solder joint between the LEDs 107 and the underlying LED PCBs 109.

A separate driver PCB 151 contains a driver circuit 133 and is electrically coupled to an interconnection PCB 154 for connecting the LED PCBs 109 to the driver circuit 133. In some embodiments, the driver circuit 133 is a dimming dual channel driver having an isolated first stage integrated circuit and a second stage Buck-Boost converter. For example, some suitable embodiments of the driver circuit 133 are disclosed in a co-pending International Application Serial No. PCT/IB2010/053734, filed on Aug. 18, 2010, incorporated herein by reference. Other driver circuitry may alternatively be utilized. For example, in some embodiments a single channel driver having an isolated first stage integrated circuit may be utilized.

Figure 10:
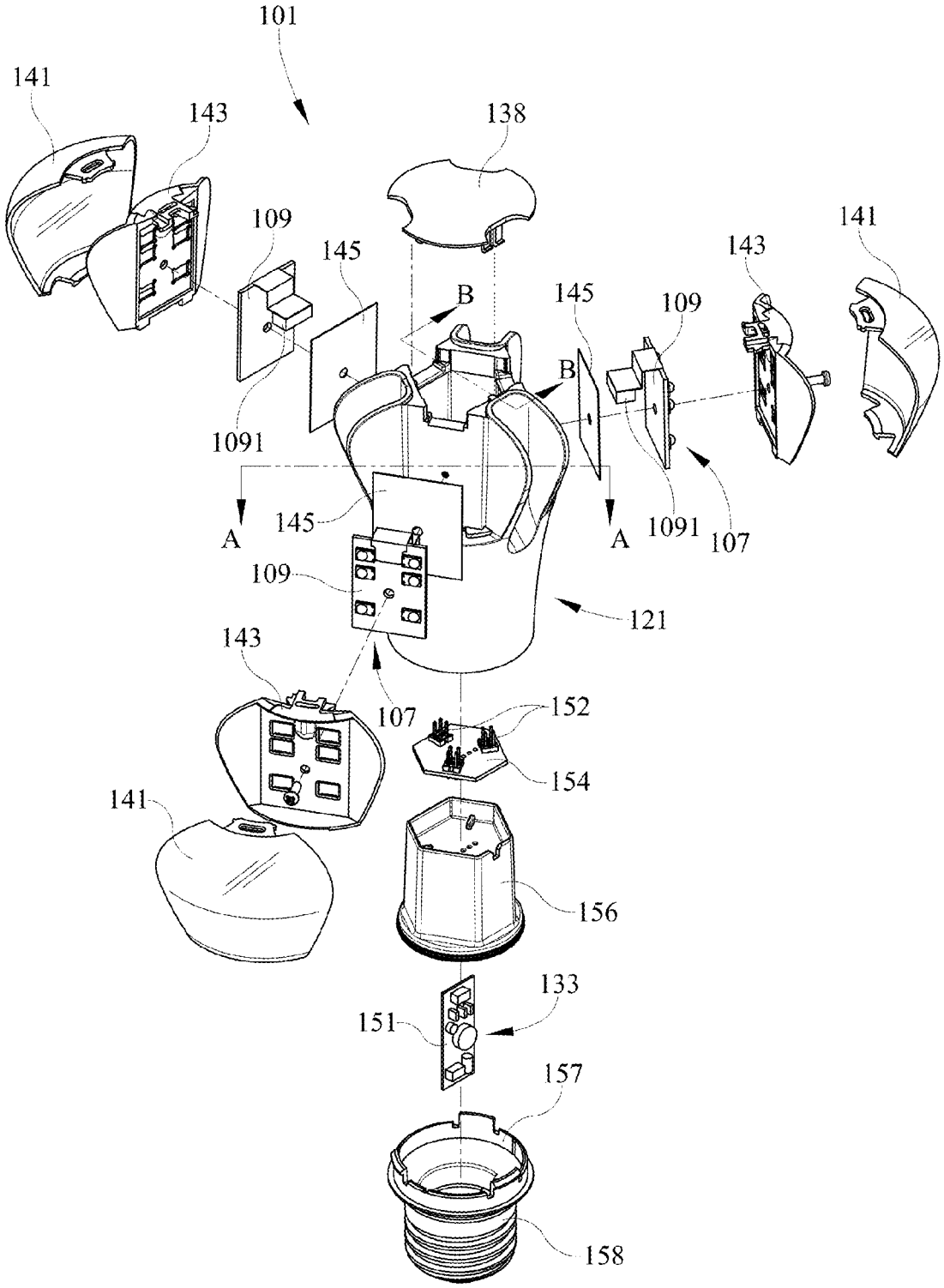
FIG. 10 shows an exploded perspective view of a tenth embodiment of a LED-based lamp.
Figure 11:
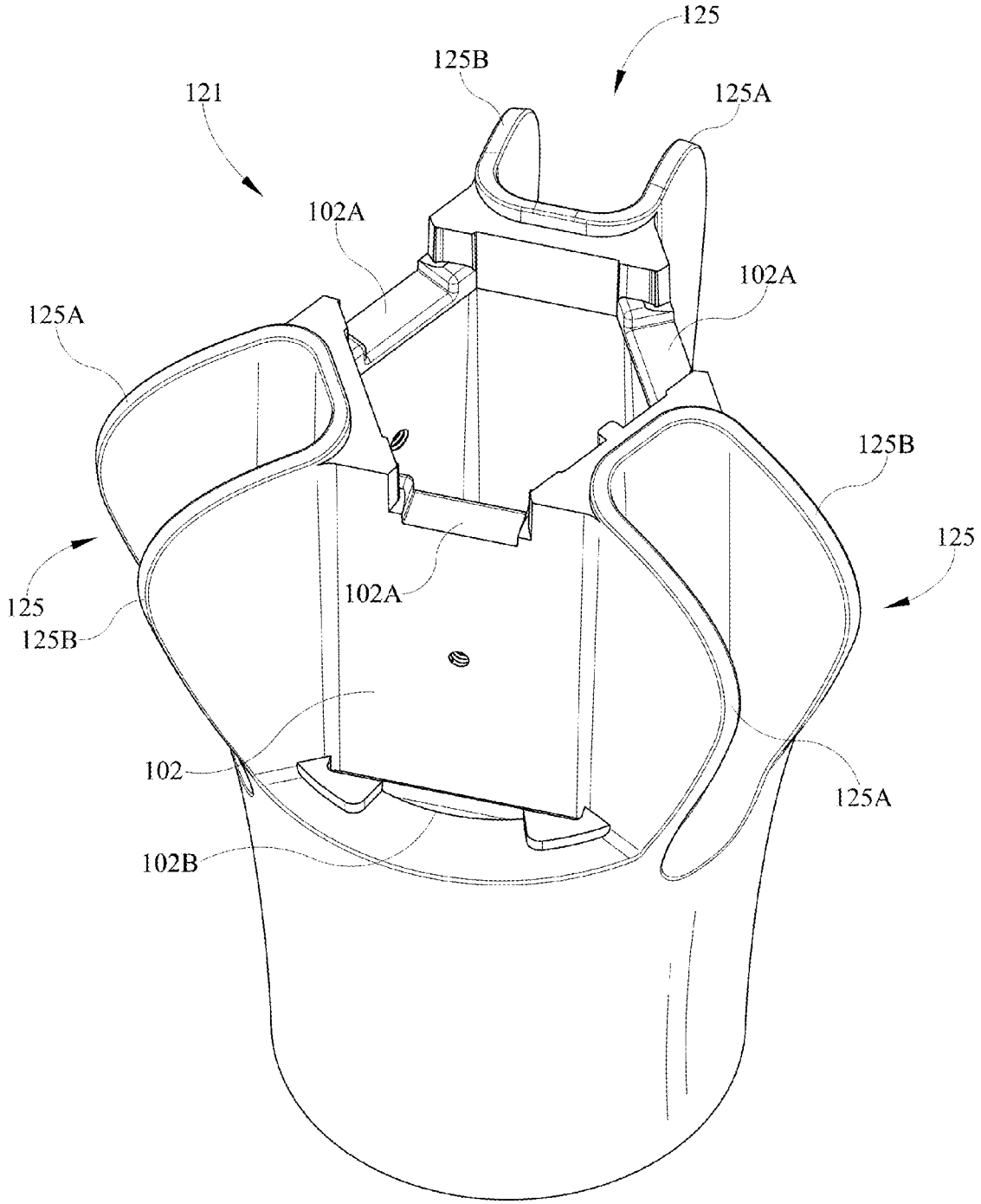
FIG. 11 shows a perspective view of a cooling structure of the LED-based lamp of FIG. 10.
Figure 12:
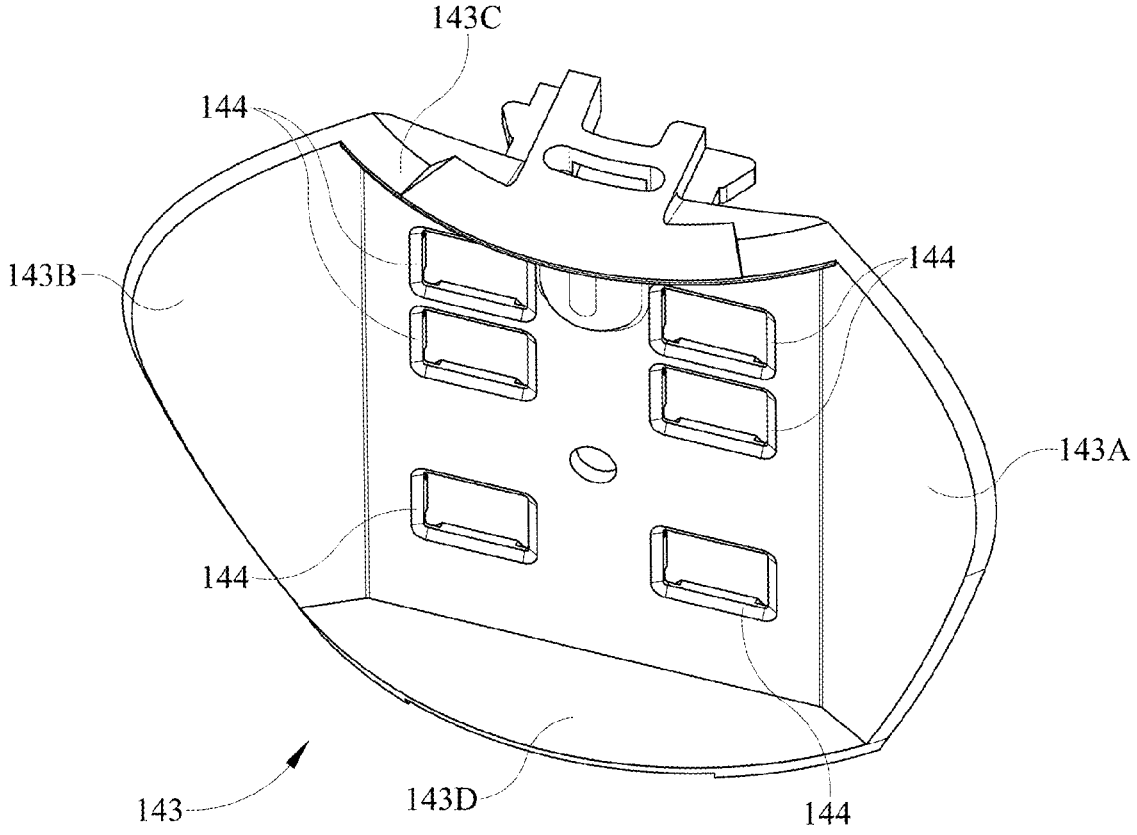
FIG. 12 shows a perspective view of a reflector of the LED-based lamp of FIG. 10.
Figure 13:
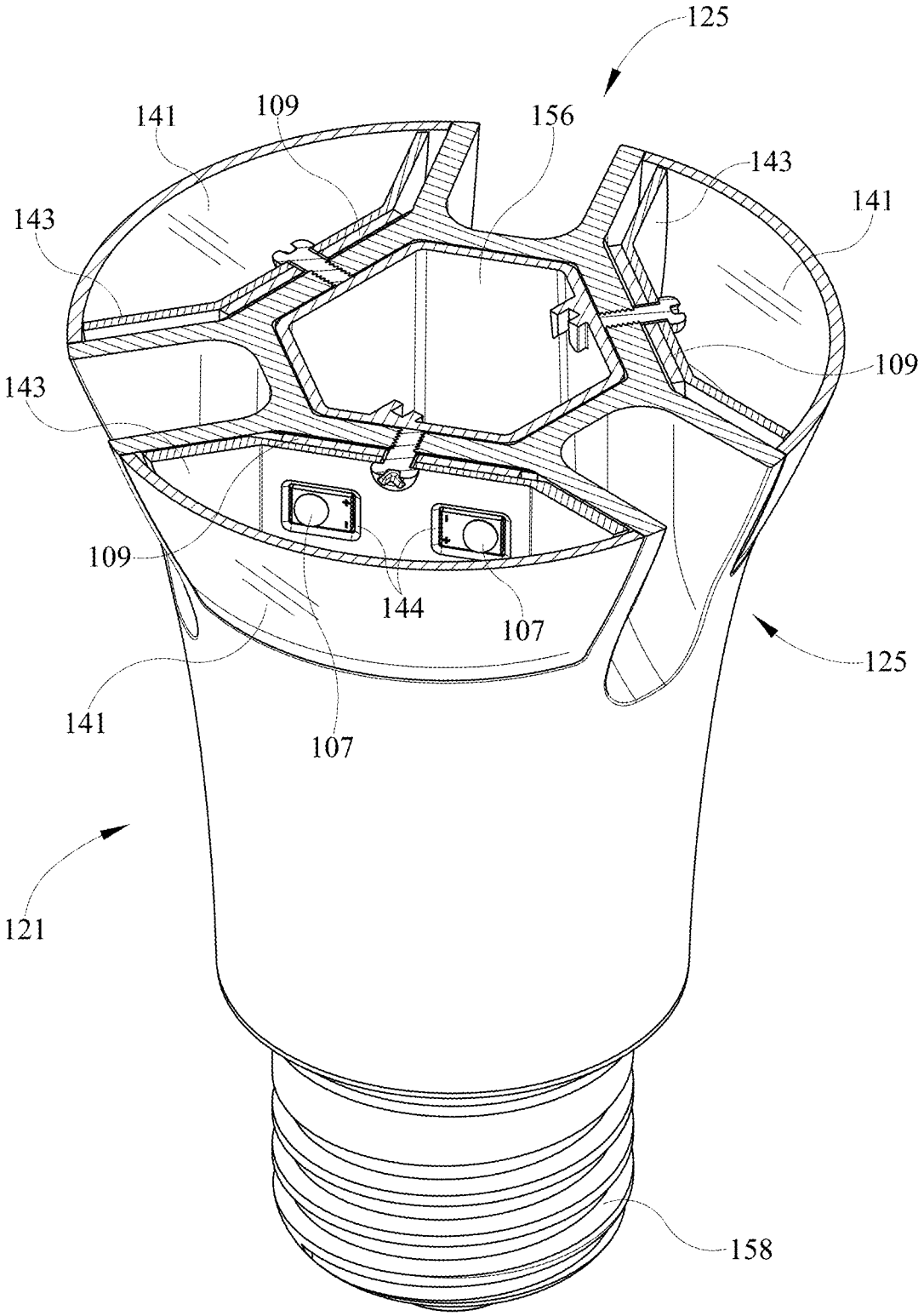
FIG. 13 shows a section view of the LED-based lamp of FIG. 10 taken along the section line A-A of FIG. 10.
Figure 14:
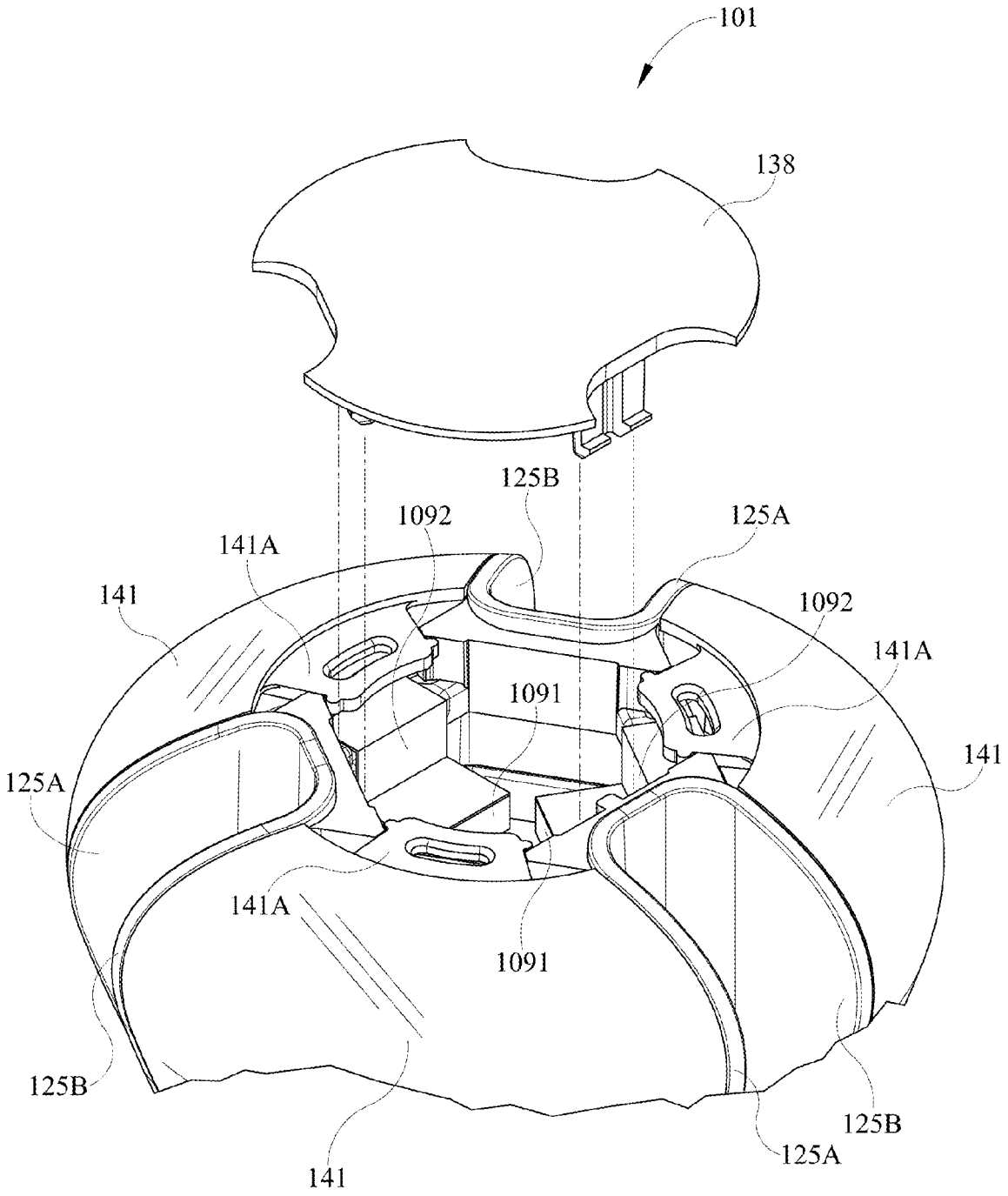
FIG. 14 shows a perspective view of the top portion of the LED-based lamp of FIG. 10 with a top cover exploded away.
Figure 15:
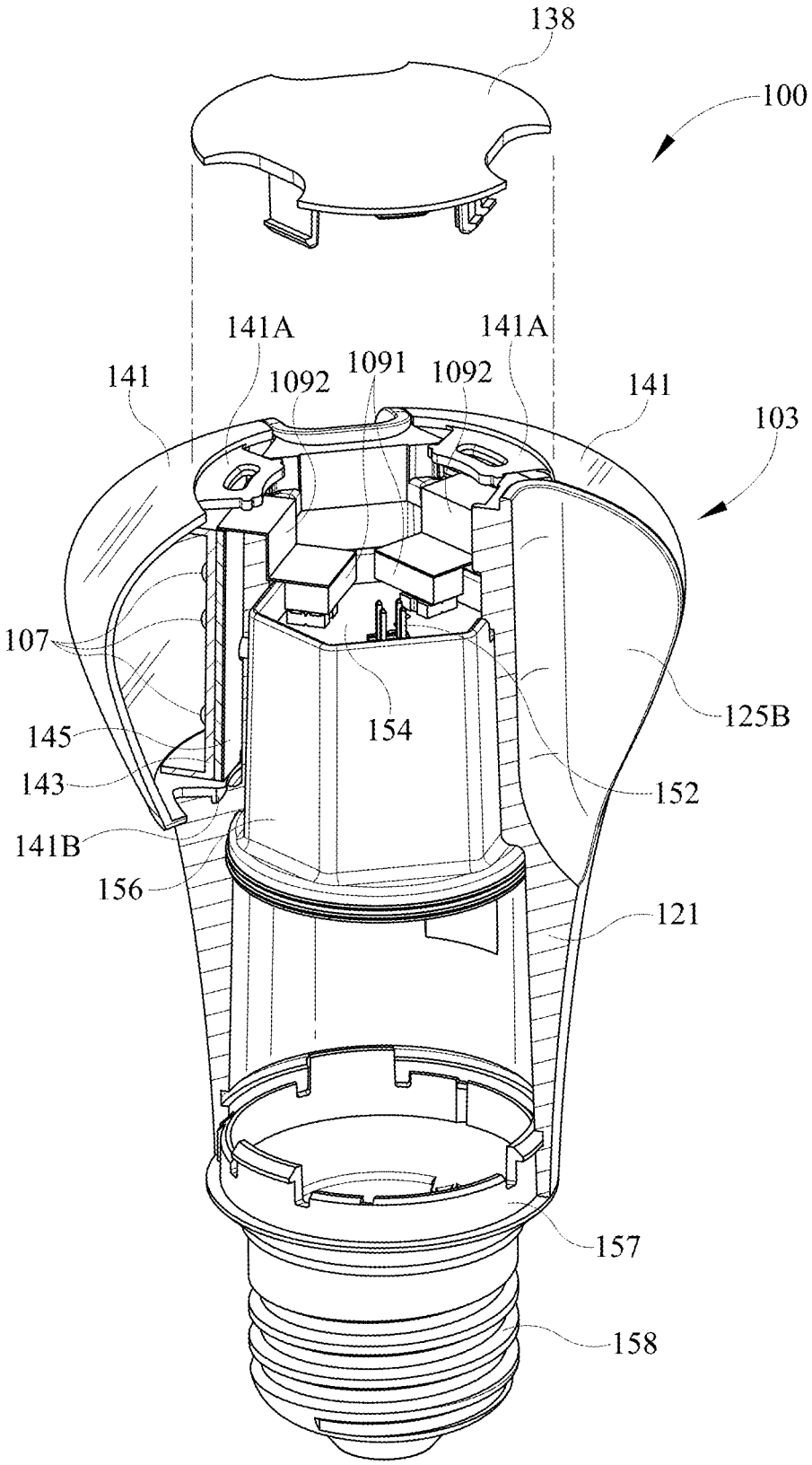
FIG. 15 shows a perspective view of the LED-based lamp of FIG. 10, the cooling structure thereof is sectioned along the section line B-B of FIG. 10; the top cover is exploded away; one set of thermal interface pads, LED PCBs, reflectors, and light-transmissive caps is not shown.
Figure 16:
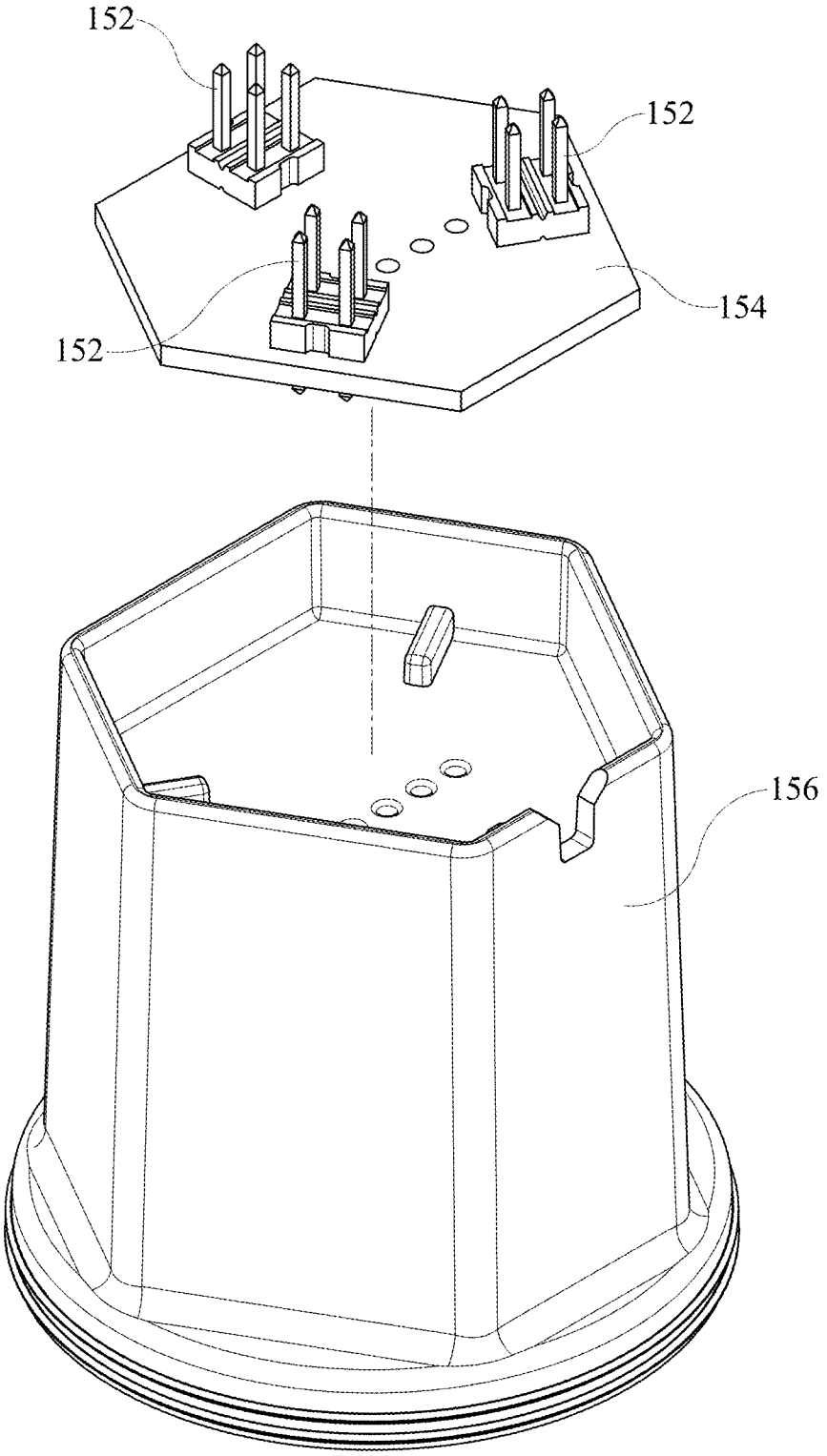
FIG. 16 shows a perspective view of a driver insulator of the LED-based lamp of FIG. 10 and an interconnection PCB; the interconnection PCB is exploded away from the driver insulator.
Figure 17:
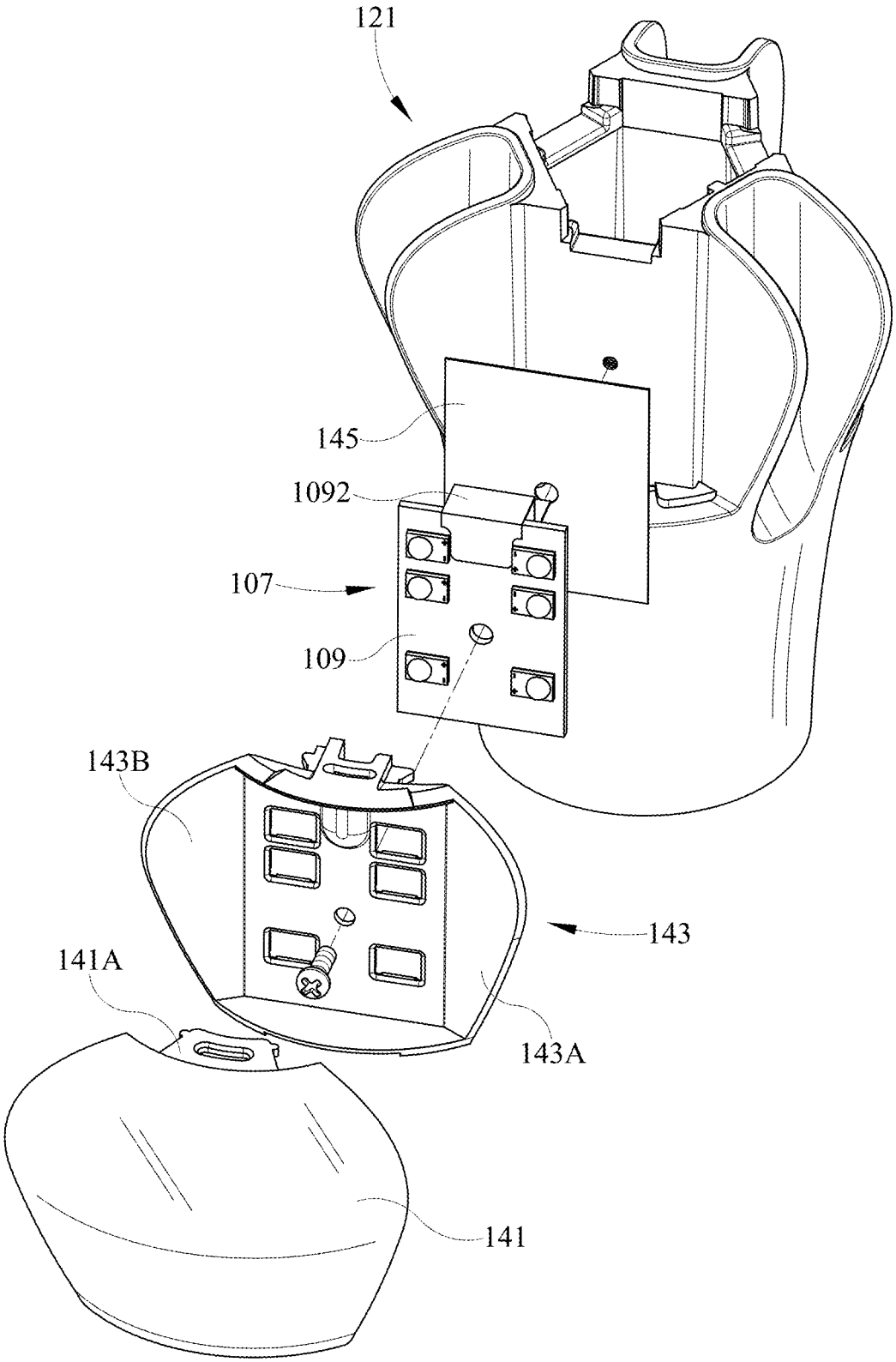
FIG. 17 shows a perspective view of the cooling structure of the LED-based lamp of FIG. 10; one set of thermal interface pads, LED PCBs, reflectors, and light-transmissive caps is also shown exploded away from the cooling, structure.

The interconnection PCB 154 is provided near the top of the lamp 101 when assembled and includes four separate male connections 152 for interfacing with corresponding female connections 1091 of the LED PCBs 109. The interconnection PCB 154 is accessible via recesses 102*a* atop planar surfaces 102 and is also accessible through a large opening atop cooling structure 121 when top cover 138 is removed. As illustrated in FIGS. 10, 15, and 16, the interconnection PCB 151 may optionally rest atop a driver insulator 156 that at least partially surrounds the driver circuit 133. As illustrated in various Figures (e.g., FIGS. 11, 14, 15, and 17), recesses 102*a* may enable a flexible printed circuit connection 1092 (a flexible electrical connection member) to extend between and electrically connect each LED PCB 109 to the interconnection PCB 154. As described in detail herein, the flexible printed circuit connection 1092 extends between and electrically connects the female connections 1091 to the LED PCB 109. In alternative embodiments other connections may be utilized including, for example, male connections on the flexible printed circuit connection 1092, female connections on the interconnection PCB 154, and/or non-flexible connections.

The cooling structure 121 has a central axially extending opening therein for receiving the driver circuit 133 and at least partially enclosing it. As a result, the driver circuit 133 can be disposed at least partially inside the cooling structure 121 and proximate to the LEDs 107. Optionally, when the lamp 101 is assembled, the driver circuit 133 may be sealed from the three separate optical chambers of the lamp 101 that each houses one of the LED PCBs 109. The driver circuit 133 is illustrated as being received wholly within driver insulator 156. The driver insulator 156 insulates the driver electronics, both thermally and electrically from the cooling structure 121 when disposed in the central opening thereof. In alternative embodiments driver circuit 133 may extend beyond driver insulator 156 or driver insulator 156 may be omitted. For example, in some embodiments the driver PCB 151 may extend beyond driver insulator 156 and be in contact with plastic shell 157. The driver insulator 156 may be retained within the central opening of the cooling structure 121 utilizing, for example, snap/click or other interfacing structure of the driver insulator 156 and the cooling structure 121 and/or adhesive.

The cooling structure 121 further has three planar surfaces 102 for receiving the LED PCBs 109. Three protruding portions 125 of the cooling structure 121 extend to the outer surface of the lamp 101 when assembled. Each of the protruding portions 125 includes a first arch 125A and a second arch 125B defining a channel therebetween. The depicted arches 125A, 125B are substantially parallel with one another and the peripheral edges thereof are spaced approximately thirty degrees apart relative to the central longitudinal axis of the lamp 101. The peripheral edges of adjacent arches 125A, 125B of adjacent protruding portions 125 are spaced approximately ninety degrees apart relative to the central longitudinal axis of the lamp 101. In alternative embodiments more arches may be provided with one or more of the protruding portions 125. For example, in some embodiments an additional vertically extending arch may be provided interposed between the first arch 125A and the second arch 125B. Also, in alternative embodiments the protruding portions 125 may only include a single arch or may include structure interconnecting the arches 125A.

In various embodiments (including the depicted embodiment of FIGS. 10-17), the arches 125A, 125B of each protruding portion 125 form a longitudinal channel or a slit therebetween to further improve heat dissipation efficiency due to the thermal chimney effect. The longitudinal channel may optionally extend below (in a direction toward screw cap 158) the light-transmissive caps 141 as illustrated, for example, in FIG. 10. Although depicted as an open channel along the entire length thereof, in alternative embodiments the channel may optionally be completely surrounded by protruding portion 125 along portions of the length thereof. In some embodiments the outer edges of the protruding portions 125 are curved to generally match the profile of the light-transmissive caps 141 that are discussed below. Collectively, the protruding portions 125 and light-transmissive caps 141 may generally define a bulb 103. The areas between adjacent protruding portions 125 may generally define light transmission sub-areas. In alternative embodiment the light-transmissive caps 141 may optionally extend over top of all or portions of the protruding portions 125.

To facilitate efficient heat dissipation, the material of the cooling structure 121 may be selected to have a coefficient of thermal conductivity of at least 1 W/mK, more preferably 10 W/mK or more even more preferably 20 W/mK or more and up to 101 or 500 W/mK. Suitable materials for the cooling means are metals such as aluminum, copper, alloys thereof, or thermally conductive plastics, for example as available via Coolpoly®, for example white/black Coolpoly® D3606 having a thermal conductivity of 1.5 W/mK, or white Coolpoly® D1202 having a thermal conductivity of 5 W/mK. In one particular embodiment, the heatsink is made of thixomolded Mg-based alloy (such as AZ91D).

The injection-molded light-transmissive plastic caps 141 may optionally be provided with phosphor conversion material coated thereon. In some embodiments the phosphor conversion material may include a LuAG/YAG phosphor mixture. The caps 141 also optionally diffuse the light output from the LEDs 107. Embodiments of lamp 101 produce white light by combining light generated directly by blue and red of LEDs 107 and indirectly by phosphor-conversion of some of the blue light. This approach may be advantageous for its efficiency of generating white light at CRI>90. Heat generation in phosphor is taken away from the blue LED package, while red LEDs have sharper spectral distribution than red phosphor would have. Optically, the shape of the caps 141 may be optimized for omnidirectional uniformity of the radiation distribution taking into account positioning of the LEDs 107 relative to the longitudinal axis of the device. In some embodiments, each light-transmissive cap 141 can be releasably fixed onto the heat sink, for example, via a click/snap connection which enables ready exchange of these parts. The replace-ability feature renders the device to have the advantage that properties of light-transmissive caps 141 may be chosen as desired and the beam properties may be easily adjustable. The light-transmissive caps 141 may be provided, for example, with diffusely transparent or translucent characteristics, optionally with a reflective pattern, or, for example with a transparent characteristic provided with a chosen blend of remote phosphor material to set the color or color temperature of the lamp. In the case where the light-transmissive caps 141 are optical elements via which the direction of the light rays emitted by LEDs 107 are controlled, the beam characteristics or the light distribution is relatively easily adjustable via selection of optical characteristics thereof.

In the depicted embodiment the light-transmissive caps 141 may be removably attached to the cooling structure 121. Each of the light-transmissive caps 141 includes a lower protrusion 141B (See e.g., FIGS. 10 and 15) that may be received in a corresponding receptacle 102B (See e.g., FIGS. 11 and 15) below each planar surface 102. Each light-transmissive cap 141 also includes an upper extension 141A (See e.g., FIGS. 10, 14, and 15) that may be placed through a corresponding recess 102A (See e.g., FIGS. 11, 14, and 15) above each planar surface 102 when the top cover 138 is un-attached. Each of the upper extensions 141A includes a pair of opposed side protrusions that prevent the upper extension 141A from being removed from a recess 102A when the top cover 138 is attached (See e.g., FIG. 14).

Three reflectors 143 (corresponding to the number of LED PCBs 109) are illustrated in FIGS. 10, 12, 15, and 17. The reflectors 143 may collect light that might otherwise be absorbed by the cooling structure 121 and direct the light toward light-transmissive caps 141. In some embodiments the reflectors 143 may be made of microcellular PET GB material. In other embodiments the reflectors 143 may be made of polycarbonate material. The reflectors 143 include openings 144 that each surround an individual of the LEDs 107. In other embodiments the opening(s) 144 may be sized to surround multiple LEDs 107. The reflectors 143 generally conform to the shape of a single of the segments of the cooling structure 121. The reflectors 143 each include side extensions 143A, 143B that contact and/or are immediately adjacent faces of protruding portions 125 of the cooling structure 121. Also, the reflectors 143 each include top and bottom extensions 143C, 143D that may contact and/or be immediately adjacent other portions of the cooling structure 121. The reflectors 143 also include an extension extending rearward from the top extension 143C that may be received in recess 102A to help retain reflector 143 in position in a similar manner as described with respect to upper extension 141A of light-transmissive caps 141. Such extension may also optionally contain structure that interfaces with corresponding structure on light-transmissive caps 141 to help retain light-transmissive caps 141 in position.

Thermal interface pads 145 are interposed between the LED PCBs 109 and the cooling structure 121. The thermal interface pads 145 assist in connecting the LED PCBs 109 thermally to the cooling structure 121. The illustrated thermal interface pads 145 only physically contact the planar surfaces 102 but in alternative embodiments may optionally include extensions that physically contact the protruding portions 125 of the cooling structure 121. Ceramic screws are also included and each extends through openings of a single of reflectors 143, LED PCBs 109, and thermal interface pads 145 and is received in a receptacle in one of planar surfaces 102 to thereby secure the thermal pads 145, LED PCBs 109, and reflectors 143 to the cooling structure 121.

The lamp 101 also includes a base which, in the depicted embodiment, includes an Edison screw cap 158 and a plastic shell 157 to electrically isolate the Edison screw cap 158 from the cooling structure 121. The plastic shell 157 also includes prongs for snap connection to the cooling structure 121 as illustrated in FIG. 15. In some embodiments the plastic shell 157 may support the driver PCB 151 and/or driver insulating shell 156.

In some embodiments the major steps for assembling the lamp 101 may include the following, presented in a functional, but not particular, order. Sub-assembly and testing of the LED PCBs 109. Fastening each set of the reflectors 143, LED PCBs 109, and thermal interface pads 145 to a designated surface on the cooling structure 121 with one screw (repeat three times). Slide the driver circuit 153 into the insulating shell 156. Connect driver circuit 153 to the interconnection PCB 154. Insert the insulating shell 156 into the cavity of the cooling structure 121. Connect the three LED PCBs 109 to the interconnection PCB 154. Snap-connect the Edison shell 157 to the cooling structure 121. Crimp, and solder two wires from the driver electronics PCB 151 to the Edison screw cap 158 and screw on the Edison screw cap 158. Snap-connect the light-transmissive caps 141 to the cooling structure 121. Snap connect the top cover 138 to the cooling structure 121.

Figure 18:
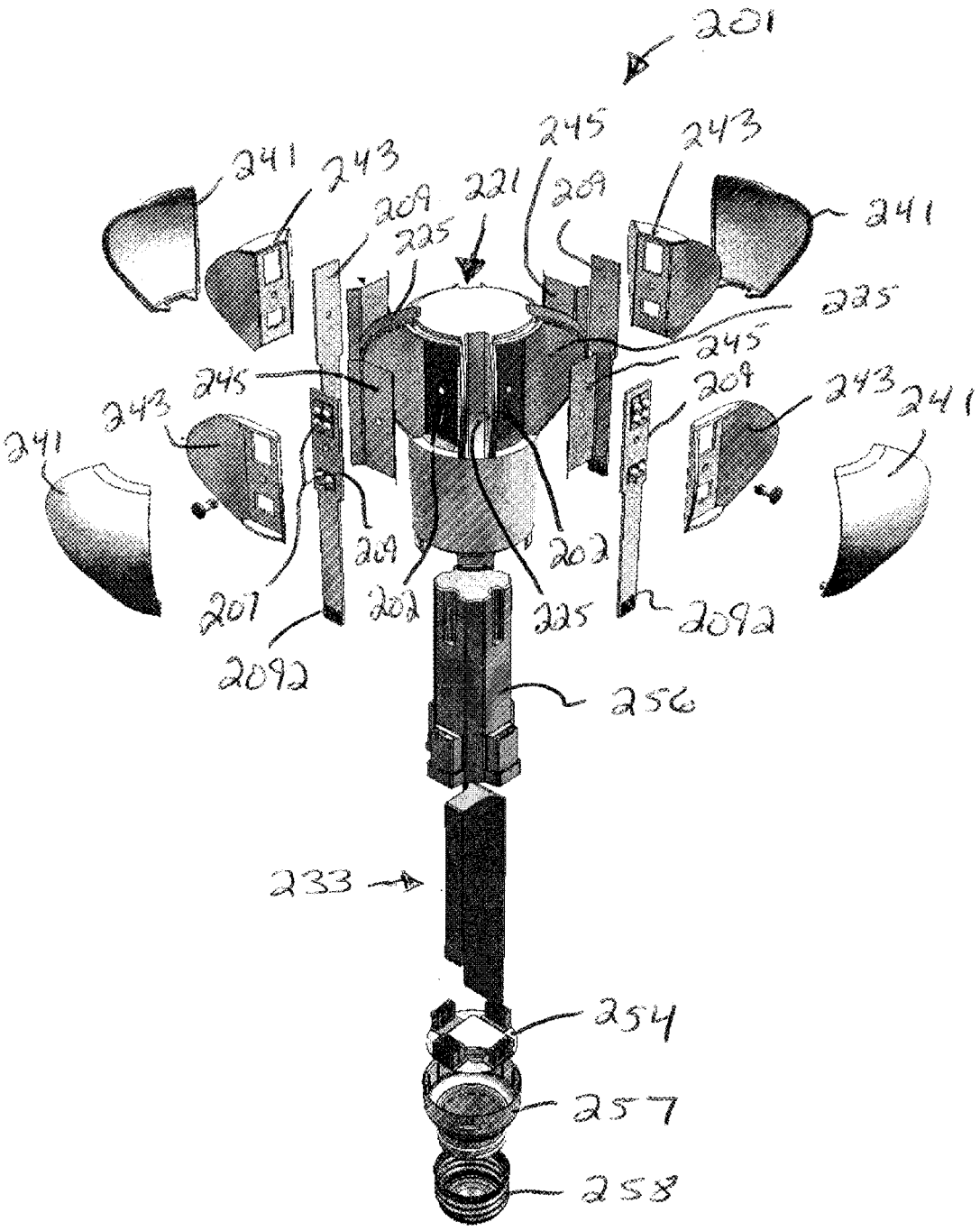
FIG. 18 shows an exploded perspective view of an eleventh embodiment of a LED-based lamp.

Referring now to FIG. 18, an exploded view of an eleventh embodiment of a LED-based lamp 201 is illustrated. The eleventh embodiment 201 contains some similarities with the tenth embodiment and like numbering between the two generally refers to like parts. Four LED PCBs 209 are provided on four opposed planar surfaces 202 of the cooling structure 221. The LED PCBs 209 include rigid connections 2092 formed therewith that connect to corresponding connection members on interconnection PCB 254 provided near the bottom of the lamp close to the Edison shell 257. The interconnection PCB 254 is electrically connected to driving circuit 233 which, in turn, is electrically connected to the Edison screw cap 258. An insulator 256 is provided that is slidably placeable over driving circuit 233. Four separate protruding portions 225 are also provided and do not extend below the four separate light-transmissive caps 241 when the lamp 200 is assembled. Four separate thermal pads 245 and reflectors 243 are also provided. The thermal pads 245 include extensions that are adjacent an optionally contact walls of the protruding portions 225.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

What is claimed is:

1. An LED-based lamp, comprising:

a socket surrounding a longitudinal lamp axis;

a cooling structure having a plurality of substantially planar surfaces radially arranged about said lamp axis and a plurality of protruding portions; wherein each of said protruding portions is positioned between two of said surfaces and extends outward and away from said lamp axis and each of said surfaces; and wherein each of said surfaces is substantially parallel to said lamp axis;

a plurality of LED PCBs, each of said LED PCBs coupled to a single of said surfaces;

driving electronics substantially enclosed within said cooling structure and electrically coupled to each of said LED PCBs and to said socket; and a plurality of light transmittable caps each positioned over a single of said LED PCBs and extending between two adjacent of said protruding portions.

2. The LED-based lamp of claim 1, further comprising a plurality of thermal pads, each of said thermal pads interposed between a single of said LED PCBs and a single of said surfaces.

3. The LED-based lamp of claim 1, further comprising a plurality of reflectors, each of said reflectors placed over a single of said LED PCBs and containing at least one LED opening therein.

4. The LED-based lamp of claim 3, wherein each of said reflectors includes a pair of side extensions, each of said side extensions covering at least some of a single of said protruding portions.

5. The LED-based lamp of claim 1, wherein said protruding portions include a longitudinally extending cooling channel therein.

6. The LED-based lamp of claim 5, wherein said cooling channel extends below said light transmittable caps in a direction toward said socket.

7. The LED-based lamp of claim 5, wherein the periphery of said protruding portions generally conforms to the periphery of said light transmittable caps.

8. An LED-based lamp, comprising:

a socket surrounding a longitudinal lamp axis;

a cooling structure having a plurality of protruding portions and a plurality of light-transmission sub-areas; said light-transmission sub-areas each generally defined between a pair of said protruding portions; wherein said protruding portions and said light-transmission sub-areas are arranged about said lamp axis in an alternating configuration;

a plurality of LED arrays, each of said LED arrays retained within a single of said light-transmission sub-areas;

driving electronics substantially enclosed within said cooling structure and electrically coupled to each of said LED arrays and to said socket; and a plurality of light transmittable caps each covering a single of said light transmission sub-areas;

wherein the periphery of said light transmittable caps substantially conforms to the periphery of said protruding portions.

9. The LED-based lamp of claim 8, wherein said LED arrays each include a flexible electrical connection member electrically coupled thereto and electrically coupled to said driving electronics.

10. The LED-based lamp of claim 9, further comprising an interconnection PCB electrically interposed between said flexible electrical connection member and said driving electronics.

11. The LED-based lamp of claim 10, wherein said interconnection PCB is accessible via at least one electrical connection opening through said cooling structure, said at least one electrical connection opening being near an end of said LED-based lamp distal said socket.

12. The LED-based lamp of claim 8, wherein said light transmission sub-areas are all substantially the same size.

13. The LED-based lamp of claim 12, wherein the number of said light transmission sub-areas is from two to four.

14. The LED-based lamp of claim 8, further comprising a plurality of reflectors, each of said reflectors placeable over a single of said LED arrays and containing at least one LED opening therein, wherein each of said LED arrays includes a LED PCB compressed between a single of said reflectors and said cooling structure.

15. An LED-based lamp, comprising:

a socket surrounding a lamp axis;

driving electronics electrically coupled to said socket;

at least three interconnection connection members each electrically coupled to said driving electronics;

a cooling structure surrounding said interconnection connection members and at least partially surrounding said driving electronics, said cooling structure having a plurality of interspersed light-transmission sub-areas arranged about said lamp axis;

a plurality of LED arrays, each of said LED arrays retained within a single of said light-transmission sub-areas;

a plurality of flexible electrical connection members each electrically and physically coupled to a single of said LED arrays and electrically and physically coupled to a single of said interconnection connection members;

wherein said flexible electrical connection members each extend through a single of a plurality of pathways through said cooling structure, and wherein each of said pathways is a recess atop the cooling structure enclosed with a top cover installed thereover.

16. The LED-based lamp of claim 15, wherein each said recess retains an extension extending from a light-transmissive cap provided across a single of said light-transmission sub-areas.

17. An LED-based lamp, comprising:

a socket surrounding a lamp axis;

driving electronics electrically coupled to said socket;

at least three interconnection connection members each electrically coupled to said driving electronics;

cooling structure surrounding said interconnection connection members and at least partially surrounding said driving electronics, said cooling structure having a plurality of interspersed light-transmission sub-areas arranged about said lamp axis;

at least three interconnection connection members each electrically coupled to said driving electronics;

a cooling structure surrounding said interconnection connection members and at least partially surrounding said driving electronics, said cooling structure having a plurality of interspersed light-transmission sub-areas arranged about said lamp axis;

a plurality of LED arrays, each of said LED arrays retained within a single of said light-transmission sub-areas;

a plurality of flexible electrical connection members each electrically and physically coupled to a single of said LED arrays and electrically and physically coupled to a single of said interconnection connection members;

wherein said flexible electrical connection members each extend through a single of a plurality of pathways through said cooling structure, and wherein said interconnection connection members are all coupled to an interconnection PCB.

18. A LED-based lamp, comprising:

a socket surrounding a lamp axis;

driving electronics electrically coupled to said socket;

at least three interconnection connection members electrically coupled to said driving electronics;

a cooling structure surrounding said interconnection connection members and at least partially surrounding said driving electronics, said cooling structure having a plurality of interspersed light-transmission sub-areas arranged about said lamp axis;

a plurality of LED arrays, each of said LED arrays retained within a single of said light-transmission sub-areas;

a plurality of flexible electrical connection members each electrically and physically coupled to a single of said LED arrays and electrically and physically coupled to a single of said interconnection connection members;

wherein said flexible electrical connection members each extend through a single of a plurality of recesses atop the cooling structure, said recesses being enclosed by a top cover installed thereover and coupled to said cooling structure and wherein said interconnection connection members are all coupled to an interconnection PCB.

19. The LED-based lamp of claim 18, further comprising a plurality of light-transmissive caps each provided across a single of said light-transmission sub-areas.

20. The LED-based lamps of claim 19, wherein said light-transmissive caps each include an extension extending through a single of said recesses.

21. A LED-based lamp, comprising:

a socket surrounding a lamp axis;

driving electronics electrically coupled to said socket;

at least three interconnection connection members electrically coupled to said driving electronics;

a cooling structure surrounding said interconnection connection members and at least partially surrounding said driving electronics, said cooling structure having a plurality of interspersed light-transmission sub-areas arranged about said lamp axis;

a plurality of LED arrays, each of said LED arrays retained within a single of said light-transmission sub-areas;

a plurality of flexible electrical connection members each electrically and physically coupled to a single of said LED arrays and electrically and physically coupled to a single of said interconnection connection members; and a plurality of reflectors, each of said reflectors placeable over a single of said LED arrays and containing at least one LED opening therein, each of said reflectors including an extension extending through a single of said recesses, wherein said flexible electrical connection members each extend through a single of a plurality of recesses atop the cooling structure, said recesses being enclosed by a top cover installed thereover and coupled to said cooling structure.

22. The LED-based lamp of claim 21, wherein each of said LED arrays includes a LED PCB compressed between a single of said reflectors and said cooling structure.

23. The LED-based lamp of claim 22, further comprising a plurality of thermal interface pads, each of said interface pads interposed between a single said LED PCB and said cooling structure.

* * * * *